US009411267B2

(12) United States Patent
Nakaue et al.

(10) Patent No.: US 9,411,267 B2
(45) Date of Patent: Aug. 9, 2016

(54) DEVELOPER STORING CONTAINER, AND IMAGE FORMING APPARATUS PROVIDED WITH THE SAME

(71) Applicant: KYOCERA Document Solutions Inc., Osaka (JP)

(72) Inventors: Takahisa Nakaue, Osaka (JP); Daisuke Eto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/838,003

(22) Filed: Aug. 27, 2015

(65) Prior Publication Data

US 2016/0062268 A1 Mar. 3, 2016

(30) Foreign Application Priority Data

Aug. 27, 2014 (JP) ..... 2014-172431

(51) Int. Cl.
*G03G 15/08* (2006.01)

(52) U.S. Cl.
CPC ..... *G03G 15/0877* (2013.01)

(58) Field of Classification Search
USPC ..... 399/107, 110, 111, 119, 120, 252, 399/258–263; 222/DIG. 1
See application file for complete search history.

(56) References Cited

U.S. PATENT DOCUMENTS 6,862,420 B1 * 3/2005 Less ..... G03G 15/0884 399/258
8,918,032 B2 * 12/2014 Abler ..... G03G 15/0877 399/262

FOREIGN PATENT DOCUMENTS

JP 2001-092230 A 4/2001

* cited by examiner

*Primary Examiner* — Hoan Tran
(74) *Attorney, Agent, or Firm* — Hawaii Patent Services; Nathaniel K. Fedde; Kenton N. Fedde

(57) ABSTRACT

Provided are a developer storing container, including a movable moving wall, and suppressing a developer from being leaked to a moving direction upstream side of the moving wall, and an image forming apparatus, provided with the same A toner container is provided with a container main body, a moving wall, a toner discharge port, and an inner wall seal. The toner container replenishes toner to a developing apparatus. The moving wall conveys the toner while being moved toward the toner discharge port inside the container main body. The inner wall seal forms an outer peripheral part of the moving wall, and is compressively deformed between an inner peripheral part of the container main body and the moving wall. A cross-sectional area of an internal space of the container main body is set so as to be decreased as a final position of the moving wall is approached.

7 Claims, 19 Drawing Sheets

DEVELOPER STORING CONTAINER, AND IMAGE FORMING APPARATUS PROVIDED WITH THE SAME

INCORPORATION BY REFERENCE

This application is based on and claims the benefit of priority from Japanese Patent Application No. 2014-172431 filed on Aug. 27, 2014, the contents of which are hereby incorporated by reference.

BACKGROUND

The present disclosure relates to a developer storing container that stores a developer, and an image forming apparatus provided with the same.

As a typical example of a developer storing container that stores a developer, that which is provided for an image forming apparatus is known. The image forming apparatus includes an image carrier, a developing apparatus, and a developer storing container. When the developer is supplied from the developing apparatus to the image carrier, an electrostatic latent image that is formed on the image carrier is actualized as a developer image. The developer storing container is provided with a developer discharge port, supplying a replenishing developer to a replenishing port that is provided in the developing apparatus.

A developer storing container has been disclosed which is provided with a moving wall that is moved while conveying the developer toward the developer discharge port.

SUMMARY

A developer storing container according to one aspect of the present disclosure is a developer storing container, including:

a container main body, being provided with an inner peripheral part, cylindrically extending along a first direction, and an internal space, being defined by the inner peripheral part, a developer discharge port, being opened in a bottom face part of the container main body so as to be communicated with the inner peripheral part, and a developer being discharged therefrom, a moving wall, being provided with an outer peripheral part, being disposed in tight contact with the inner peripheral part of the container main body, and a conveying face, defining a storing space together with the inner peripheral part of the container main body, the developer being stored therein; the moving wall being moved from an initial position on the one end side of said first direction to a final position on the other end side thereof in said internal space, while conveying said developer in said storing space toward said developer discharge port, and a sealing member, forming the outer peripheral part of the moving wall, and being compressively deformed between the inner peripheral part of the container main body and the moving wall, a cross-sectional area of the internal space of the container main body in a sectional view intersecting perpendicularly with the first direction being set so as to be decreased as the final position of the moving wall being approached.

DETAILED DESCRIPTION

Figure 1:
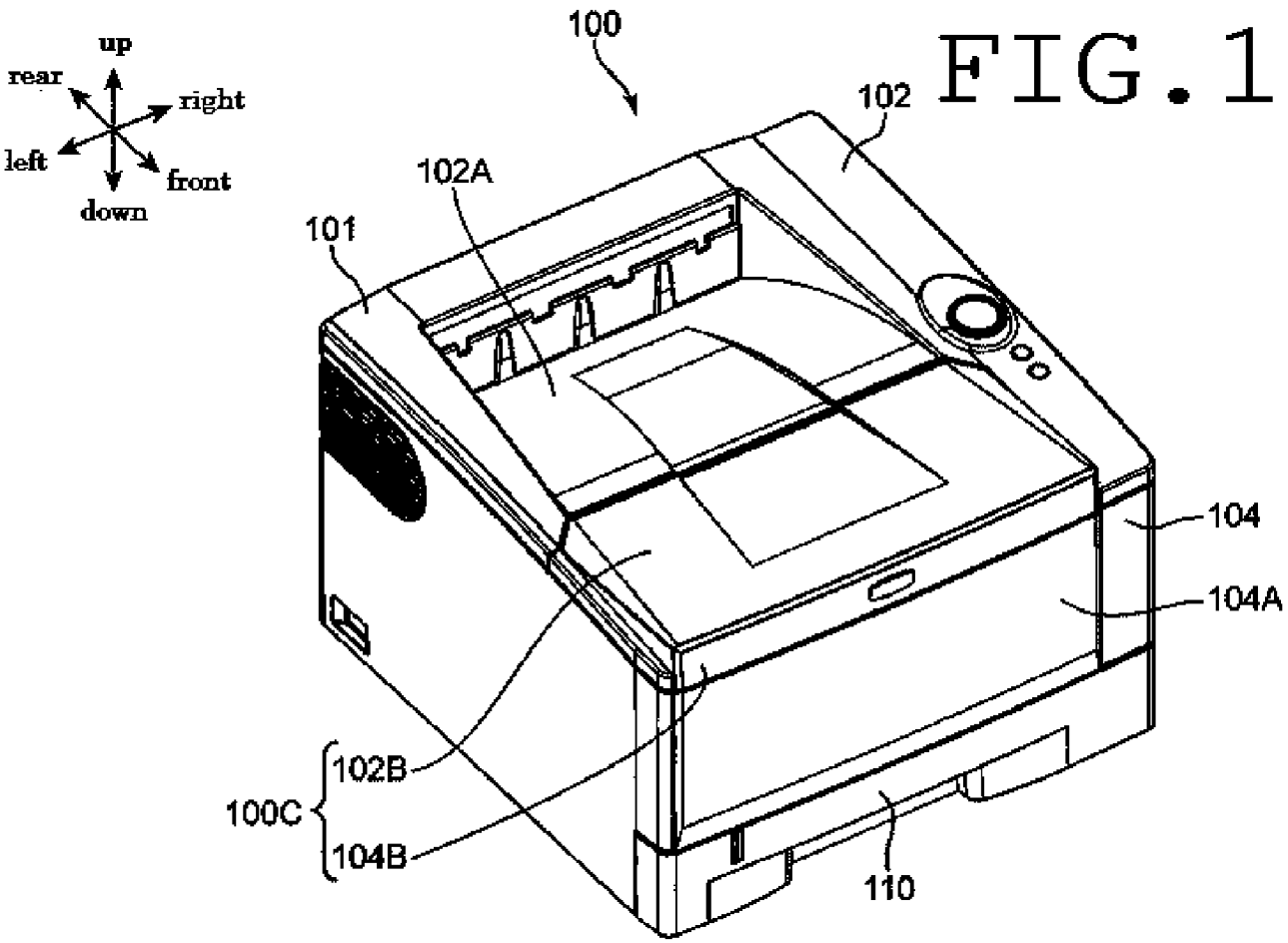
FIG. 1 is a perspective view showing an image forming apparatus according to one embodiment of the present disclosure.
Figure 2:
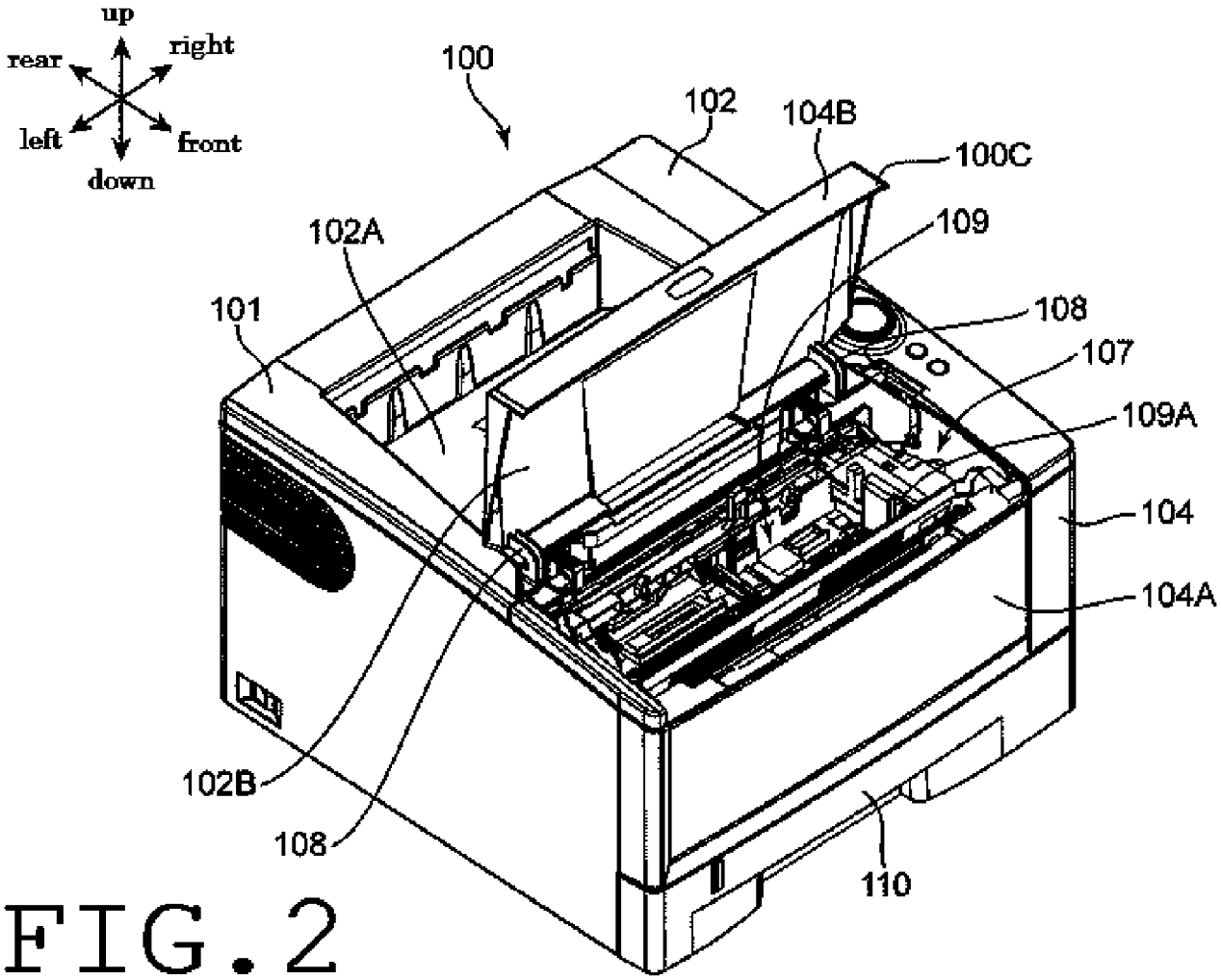
FIG. 2 is a perspective view showing the image forming apparatus according to one embodiment of the present disclosure in the state in which a part thereof is opened.
Figure 3:
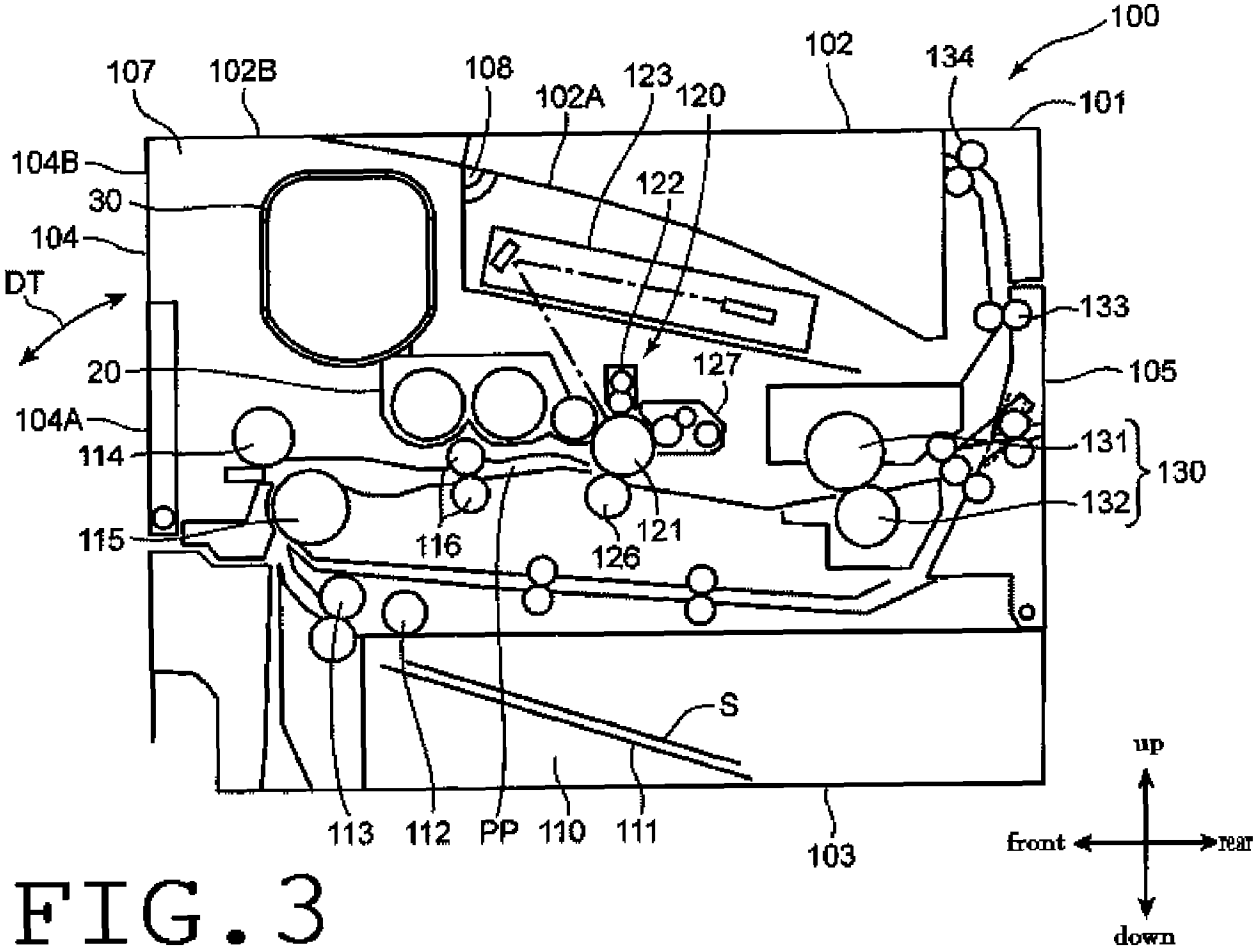
FIG. 3 is a schematic sectional view showing an internal construction of the image forming apparatus according to one embodiment of the present disclosure.

Hereinbelow, referring to the drawings, one embodiment of the present disclosure will be explained. FIG. 1 and FIG. 2 are perspective views of a printer 100 (an image forming apparatus) according to one embodiment of the present disclosure. FIG. 3 is a sectional view schematically showing an internal construction of the printer 100 shown in FIG. 1 and FIG. 2. The printer 100 shown in FIG. 1 to FIG. 3 as an image forming apparatus is a so-called monochrome printer. However, in another embodiment, the image forming apparatus may be a color printer, a facsimile apparatus, a Multifunctional Peripheral (MFP) equipped with such functions, or other apparatus for forming a toner image on a sheet. The term that is used in the following explanation to express a direction, such as “up” or “down”, “front” or “rear”, or “right” or "left", is used simply for clarification of the explanation, and will not make any limitation of the principle of the image forming apparatus.

The printer 100 is provided with a casing 101 that houses various apparatuses for forming an image on a sheet S. The casing 101 includes a top wall 102, which defines a top face of the casing 101, and a bottom wall 103, which defines a bottom face of the casing 101 (FIG. 3); a main body rear wall 105 between the top wall 102 and the bottom wall 103 (FIG. 3); and a main body front wall 104, which is located in front of the main body rear wall 105. The casing 101 is provided with a main body internal space 107, in which various apparatuses are disposed. In the main body internal space 107 in the casing 101, there is extendedly provided a sheet carrying passage PP, with which the sheet S is conveyed in a specific conveying direction. In addition, the printer 100 is provided with an opening/closing cover 100C, which is openably loaded onto the casing 101.

The opening/closing cover 100C is composed of a front wall upper part 104B, which is an upper portion of the main body front wall 104, and a top wall front part 102B, which is a front portion of the top wall 102. In addition, the opening/closing cover 100C can be opened and closed in a vertical direction with a hinge shaft (not shown) as a fulcrum, which is disposed in a pair of arm parts 108, which are provided in both end parts in a lateral direction (FIG. 2). In the open state of the opening/closing cover 100C, the top of the main body internal space 107 is opened to the outside. On the other hand, in the closed state of the opening/closing cover 100C, the top of the main body internal space 107 is closed.

In the central part of the top wall 102, a paper delivery part 102A is disposed. The paper delivery part 102A is formed of an inclination surface, which is inclined downward from the front portion of the top wall 102 to the rear portion thereof. To the paper delivery part 102A, the sheet S, on which an image is formed in a below-mentioned image forming part 120, is discharged. In addition, in the central part in a vertical direction of the main body front wall 104, a manual feed tray 104A is disposed. The manual feed tray 104A can be vertically turned with the lower end as a fulcrum (in a direction of arrow DT in FIG. 3).

Referring to FIG. 3, the printer 100 includes a cassette 110, a pickup roller 112, a first feed roller 113, a second feed roller 114, a conveyance roller 115, a registration roller pair 116, an image forming part 120, and a fixing apparatus 130.

The cassette 110 stores a sheet S in the inside thereof. The cassette 110 is provided with a lifting plate 111. The lifting plate 111 is inclined so as to push up the leading edge of the sheet S. The cassette 110 can be drawn forward with respect to the casing 101.

The pickup roller 112 is disposed on the leading edge of the sheet S, which has been pushed up by the lifting plate 111. When the pickup roller 112 is rotated, the sheet S is pulled out from the cassette 110.

The first feed roller 113 is disposed downstream of the pickup roller 112, feeding out the sheet S further downstream. The second feed roller 114 is disposed inside of the fulcrum of the manual feed tray 104A (behind it), pulling in the sheet S on the manual feed tray 104A into the casing 101.

The conveyance roller 115 is disposed downstream in the sheet conveying direction (which, hereinbelow, may be simply referred to as the conveying direction) of the first feed roller 113 and the second feed roller 114 (which, hereinbelow, may be simply referred to as downstream). The conveyance rollers 115 conveys further downstream the sheet S that has been fed out by the first feed roller 113 and the second feed roller 114.

The registration roller pair 116 has a function to correct an oblique conveyance of the sheet S. Thereby, the position of an image that is formed on the sheet S is correctly adjusted. The registration roller pair 116 supplies the sheet S to the image forming part 120 in accordance with the timing of image formation made by the image forming part 120.

The image forming part 120 includes a photosensitive drum 121 (an image carrier), an electrifier 122, an exposure apparatus 123, a developing apparatus 20, a toner container 30 (a developer storing container), a transfer roller 126 (a transfer part), and a cleaning apparatus 127.

The photosensitive drum 121 has a cylindrical shape. The photosensitive drum 121 has a surface on which an electrostatic latent image is formed, and carries a toner image (a developer image) in accordance with the electrostatic latent image on the surface. The electrifier 122, to which a specific voltage is applied, electrifies substantially uniformly the circumferential surface of the photosensitive drum 121.

The exposure apparatus 123 irradiates a laser beam onto the circumferential surface of the photosensitive drum 121, which has been electrified by the electrifier 122. The laser beam is irradiated in accordance with image data that has been outputted from an external apparatus (not shown), such as a personal computer, that is communicably connected to the printer 100. As a result of this, an electrostatic latent image corresponding to the image data is formed on the circumferential surface of the photosensitive drum 121.

The developing apparatus 20 supplies toner to the circumferential surface of the photosensitive drum 121, on which the electrostatic latent image has been formed. The toner container 30 supplies the toner (a replenishing developer) to the developing apparatus 20. The toner container 30 is detachably disposed on the developing apparatus 20. When the developing apparatus 20 supplies the toner to the photosensitive drum 121, the electrostatic latent image that has been formed on the circumferential surface of the photosensitive drum 121 is developed (visualized). As a result of this, a toner image (a developer image) is formed on the circumferential surface of the photosensitive drum 121.

The transfer roller 126 is disposed under the photosensitive drum 121, being opposed thereto with the sheet carrying passage PP being sandwiched between both. The transfer roller 126 forms a transfer nip part between it and the photosensitive drum 121 to transfer the toner image onto the sheet S.

The cleaning apparatus 127 removes the toner remaining on the circumferential surface of the photosensitive drum 121 after the toner image having been transferred onto the sheet S.

The fixing apparatus 130 is disposed on the downstream side of the image forming part 120 in the conveying direction to fix the toner image on the sheet S. The fixing apparatus 130 includes a heating roller 131, which fuses the toner on the sheet S, and a pressure roller 132, which causes the sheet S to be tightly contacted with the heating roller 131.

The printer 100 further includes a conveyance roller pair 133, which is disposed downstream of the fixing apparatus 130, and a discharge roller pair 134, which is disposed downstream of the conveyance roller pair 133. The sheet S is conveyed upward by the conveyance roller pair 133, and finally discharged from the casing 101 by the discharge roller pair 134. The sheet S, which has been discharged from the casing 101, is stacked on the paper delivery part 102A.

<About Developing Apparatus>

Figure 4:
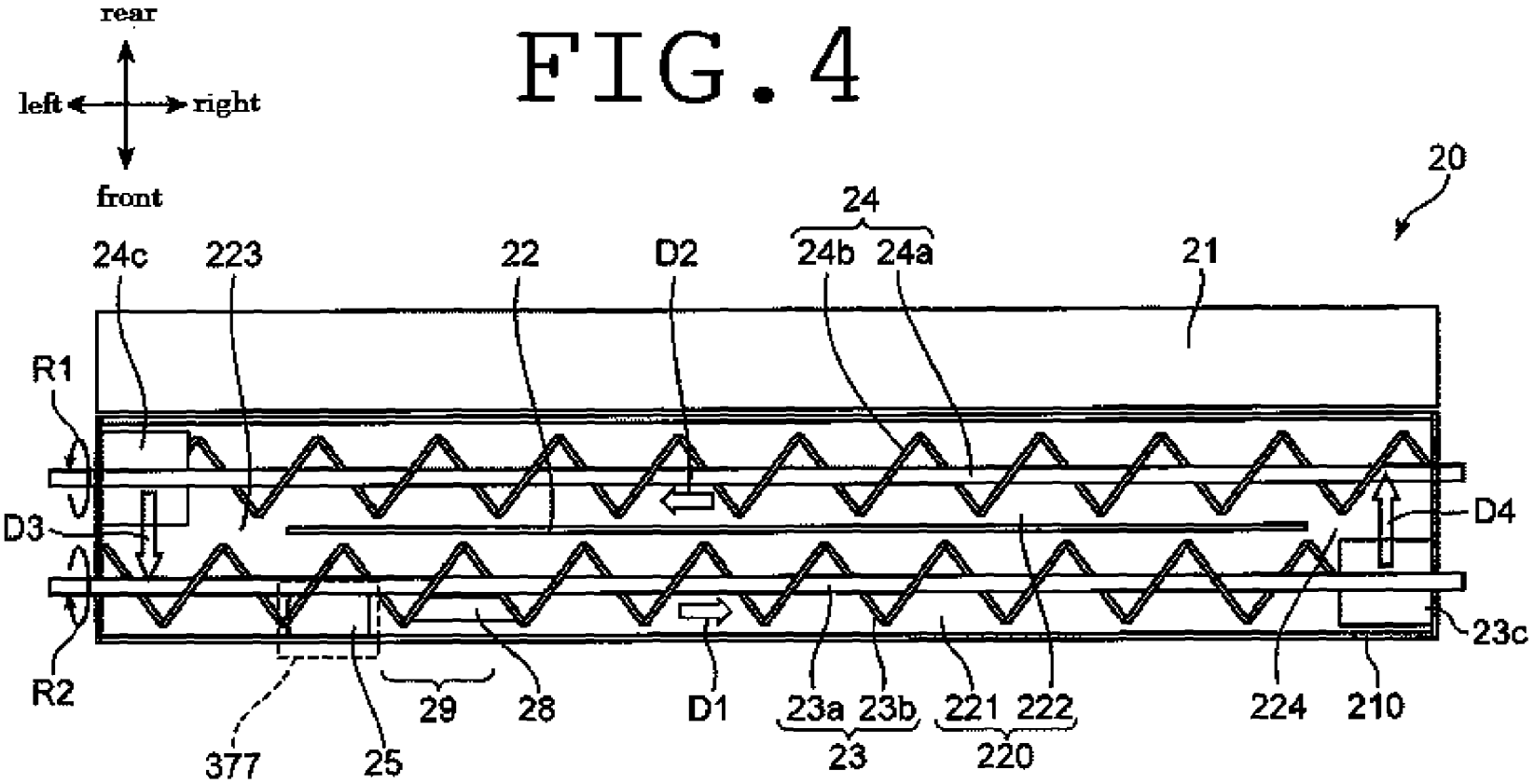
FIG. 4 is a schematic plan view showing an internal construction of a developing apparatus according to one embodiment of the present disclosure.

FIG. 4 is a plan view showing an internal construction of the developing apparatus 20. The developing apparatus 20 is provided with a developing housing 210 (a housing), which has a box shape long in one direction (the axial direction or a lateral direction of a developing roller 21). The developing housing 210 has a storing space 220 (a developer carrying passage). In the storing space 220, the developing roller 21, a first stirring screw 23 (a developer conveying member) and a second stirring screw 24, and a toner replenishing port 25 are disposed. In the present embodiment, the one-component development system is applied, and this storing space 220 is filled with toner as a developer. On the other hand, in the case of the two-component development system, a mixture of the toner and a carrier comprised of a magnetic substance is filled in as a developer. The toner is stirred and conveyed in the storing space 220, being successively supplied to the photosensitive drum 121 from the developing roller 21 to develop the electrostatic latent image.

The developing roller 21 has a cylindrical shape that is extendedly provided in a longitudinal direction of the developing housing 210, and, on the outer periphery, has a sleeve portion which is rotationally driven. The storing space 220 of the developing housing 210 is covered with a top plate (not shown), and is partitioned into a first carrying passage 221 and a second carrying passage 222, which are long in a lateral direction, by a partitioning plate 22, which is extended in a lateral direction. The partitioning plate 22 is shorter than the length in the lateral direction of the developing housing 210. At the left end and the right end of the partitioning plate 22, there are provided a first communicating passage 223 and a second communicating passage 224, which respectively communicate between the first carrying passage 221 and the second carrying passage 222. Thereby, in the storing space 220, there is formed a circulation path from the first carrying passage 221 to the first communicating passage 223 through the second communicating passage 224 and the second carrying passage 222. The toner is conveyed in the circulation path in a counterclockwise direction in FIG. 4.

The toner replenishing port 25 (the developer replenishing port) is an opening part, which is opened in the top plate of the developing housing 210, and is located upward in the vicinity of the left end of the first carrying passage 221. The toner replenishing port 25 is disposed, being opposed to the above-mentioned circulation path. The toner replenishing port 25 has a function to receive the replenishing toner (the replenishing developer), which is replenished from the toner discharge port 377 of the toner container 30 (FIG. 4) into the storing space 220.

The first stirring screw 23 is disposed in the first carrying passage 221. The first stirring screw 23 includes a first rotating shaft 23*a*, and a first spiral blade 23*b*, which is provided protrusively in a spiral shape on the circumference of the first rotating shaft 23*a*. The first stirring screw 23 is rotationally driven around the first rotating shaft 23*a* (in a direction of arrow R2), thereby conveying the toner in a direction of arrow D1 in FIG. 4. The first stirring screw 23 conveys the developer such that it passes the location where the toner replenishing port 25 is opposed to the first carrying passage 221. Thus, the first stirring screw 23 has a function of conveyance while mixing fresh toner flowing from the toner replenishing port 25 with the toner that has been conveyed from the side of the second carrying passage 222 into the first carrying passage 221. On the downstream side of the first stirring screw 23 in the toner conveying direction (the direction of D1), a first paddle 23*c* is disposed. The first paddle 23*c* is a plate-like member that is disposed on the first rotating shaft 23*a*. The first paddle 23*c* is rotated together with the first rotating shaft 23*a*, and passes the toner from the first carrying passage 221 to the second carrying passage 222 in a direction of arrow D4 in FIG. 4.

The second stirring screw 24 is disposed in the second carrying passage 222. The second stirring screw 24 includes a second rotating shaft 24*a*, and a second spiral blade 24*b*, which is provided protrusively in a spiral shape on the circumference of the second rotating shaft 24*a*. The second stirring screw 24 is rotationally driven around the second rotating shaft 24*a* (in a direction of arrow R1) to convey the toner in a direction of arrow D2 in FIG. 4, thereby supplying the toner to the developing roller 21. On the downstream side of the second stirring screw 24 in the toner conveying direction (the direction of D2), a second paddle 24*c* is disposed. The second paddle 24*c* is rotated together with the second rotating shaft 24*a*, and passes the toner from the second carrying passage 222 to the first carrying passage 221 in a direction of arrow D3 in FIG. 4.

The toner container 30 (FIG. 3) is disposed above the toner replenishing port 25 of the developing housing 210. The toner container 30 is provided with the toner discharge port 377 (FIG. 4). The toner discharge port 377 is disposed in a bottom part 371 (FIG. 8B) of the toner container 30 in correspondence to the toner replenishing port 25 in the developing apparatus 20. The toner that has been dropped from the toner discharge port 377 is replenished to the developing apparatus 20 from the toner replenishing port 25.

<About Toner Replenishment>

Figure 5:
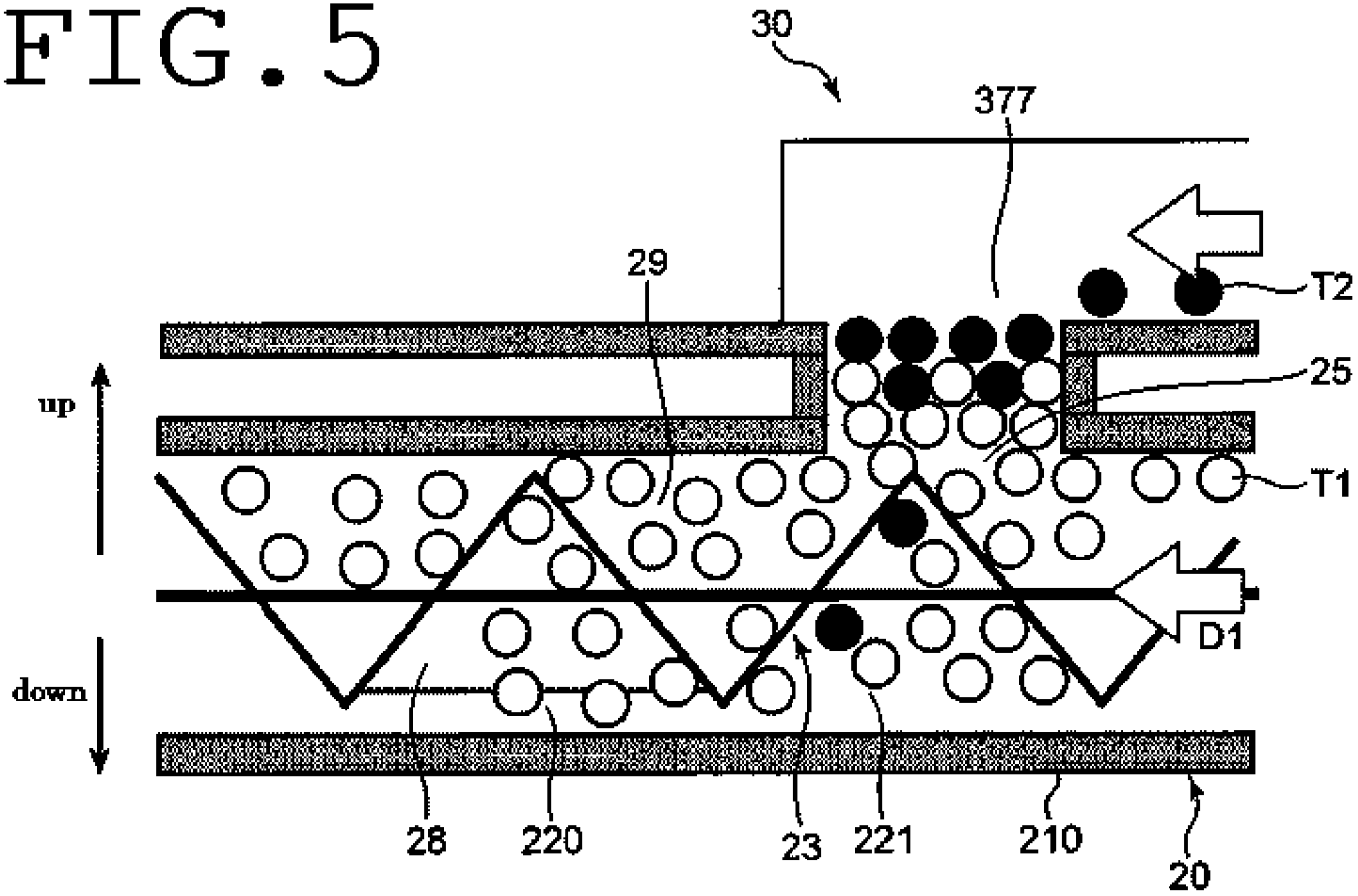
FIG. 5 is a schematic sectional view showing how a developer is replenished to the developing apparatus according to one embodiment of the present disclosure.

Next, the flow of the toner newly replenished from the toner replenishing port 25 will be explained. FIG. 5 is a sectional view of an area in the vicinity of the toner replenishing port 25, which is disposed in the developing apparatus 20, and the toner discharge port 377, which is disposed in the toner container 30.

The replenished toner T2, which has been supplied from the toner discharge port 377 of the toner container 30, is dropped into the first carrying passage 221 to be mixed with the existing toner T1, and is conveyed in the direction of arrow D1 by the first stirring screw 23. At this time, the toners T1 and T2 are stirred, and electrified.

The first stirring screw 23 is provided with a suppressing paddle 28 (a conveying capacity suppressing part), with which the performance of developer conveyance is partially suppressed, on the downstream side of the toner replenishing port 25 in the toner conveying direction. In the present embodiment, the suppressing paddle 28 is a plate-like member that is disposed between first spiral blades 23*b* of the first stirring screw 23 that are adjacent to each other. With the suppressing paddle 28 being rotated around the first rotating shaft 23*a*, the toner that is conveyed from the upstream side of the suppressing paddle 28 starts to be retained. Then, such toner retentions are accumulated to a location that is just on the upstream side of the suppressing paddle 28, and where the toner replenishing port 25 is opposed to the first carrying passage 221. As a result of this, in the vicinity of the mouth of the toner replenishing port 25, a retaining part 29 for developer (a developer retaining part) is formed. In the region where the toner replenishing port 25 is provided, the first spiral blade 23*b* is disposed (FIG. 4). In addition, in another embodiment, the conveying capacity suppressing part may be formed by providing a region where the first spiral blade 23*b* of the first stirring screw 23 is partially omitted, and thus the first rotating shaft 23*a* is partially exposed along the axial direction. With such a configuration, the conveying capacity of the first stirring screw 23 is partially suppressed, thereby a developer retaining part being formed.

If the replenishing toner T2 is replenished from the toner replenishing port 25, thereby the quantity of the toner in the storing space 220 being increased, the toner retaining in this retaining part 29 blocks (seals) the toner replenishing port 25 for suppressing further replenishment of the toner. In addition, the first spiral blade 23*b* is rotated to thereby push up the developer in the storing space 220 around the toner replenishing port 25. As a result of this, the sealing action of the toner replenishing port 25 due to the retaining part 29 is increased. Thereafter, if the toner in the storing space 220 is consumed from the developing roller 21, the quantity of the toner retaining in the retaining part 29 being decreased, the quantity of the toner that has blocked the toner replenishing port 25 is decreased, thereby a clearance being produced between the retaining part 29 and the toner replenishing port 25. As a result of this, the replenishing toner T2 is caused to again flow into the storing space 220 from the toner replenishing port 25. Thus, in the present embodiment, there has been adopted the toner replenishing form of volume replenishment type with which the quantity of the replenishing toner received is properly adjusted as the quantity of the toner retaining in the retaining part 29 is decreased. Therefore, without providing any sensor for detecting the quantity of toner in the developing housing 210 of the developing apparatus 20, it is possible to replenish a proper quantity of toner to the developing apparatus 20.

<About Loading of Toner Container onto Developing Apparatus>

Figure 6:
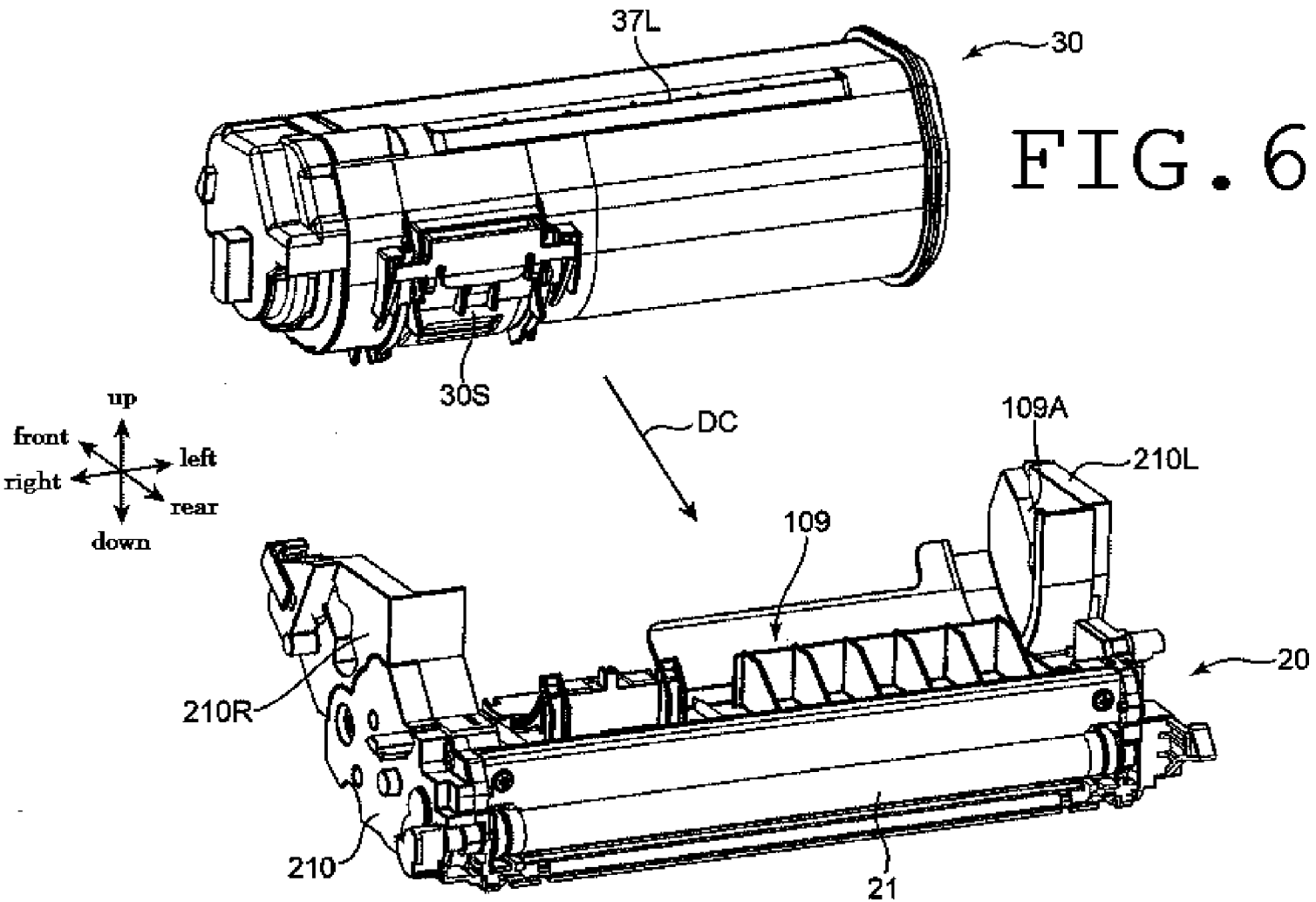
FIG. 6 is a perspective view of a developer storing container and the developing apparatus according to one embodiment of the present disclosure.
Figure 7:
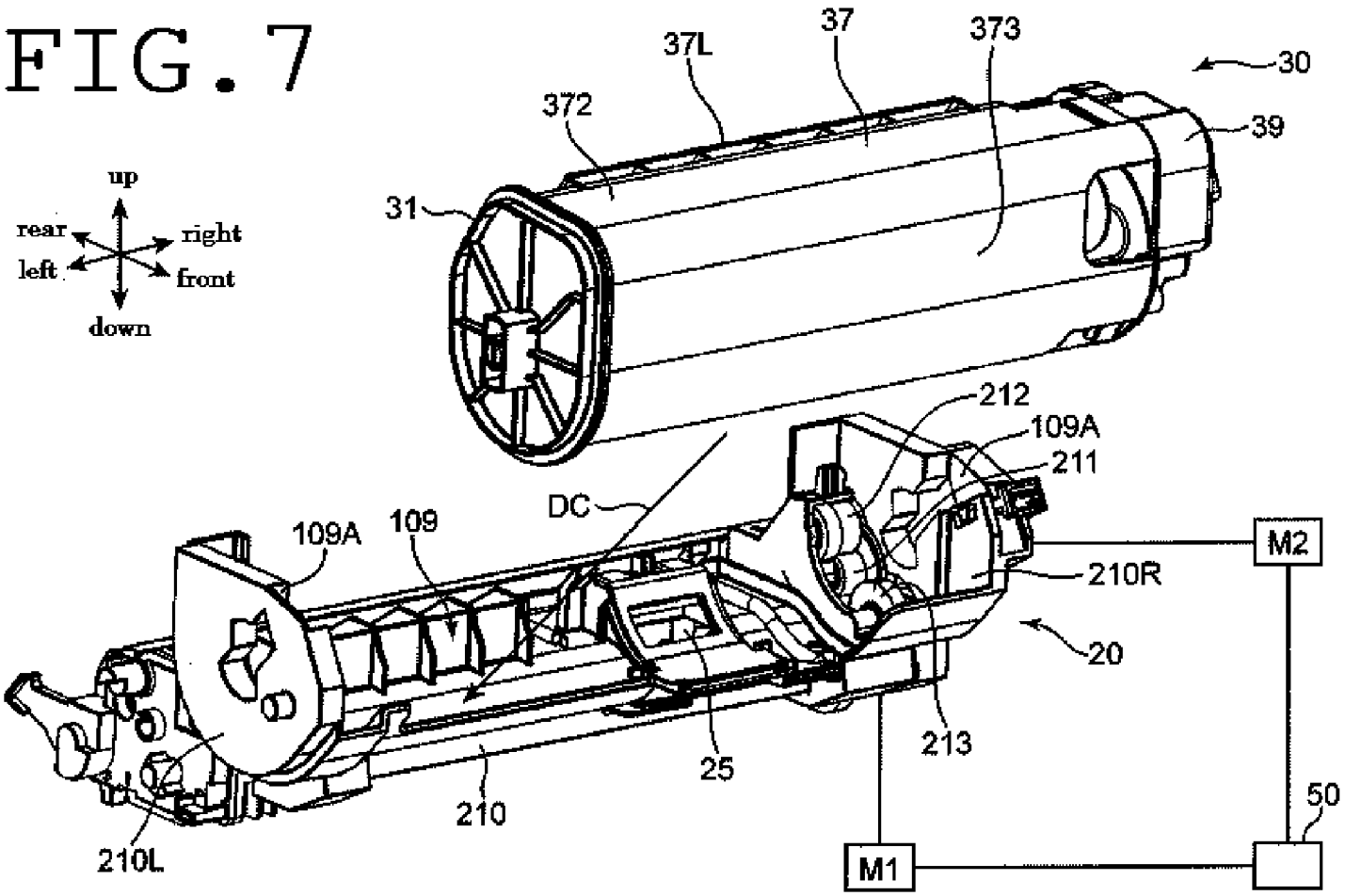
FIG. 7 is a perspective view of the developer storing container and the developing apparatus according to one embodiment of the present disclosure.

FIG. 6 and FIG. 7 are perspective views of the toner container 30 and the developing apparatus 20 according to the present embodiment. The toner container 30 can be loaded onto and removed from the developing apparatus 20 in the casing 101. Referring to FIG. 2, when the opening/closing cover 100C of the casing 101 is opened upward, a container accommodating part 109, which is provided in the developing housing 210 of the developing apparatus 20, is exposed to the outside of the casing 101. Referring to FIG. 6 and FIG. 7, the developing housing 210 is provided with a pair of a housing left wall 210L and a housing right wall 210R. The container accommodating part 109 is formed between the housing left wall 210L and the housing right wall 210R. In the present embodiment, the toner container 30 is loaded onto the container accommodating part 109 substantially from above (see arrow DC in FIG. 6 and FIG. 7). At this time, a below-mentioned cover 39 of the toner container 30 is located on the side of the housing right wall 210R, while a below-mentioned lid part 31 of the toner container 30 is located on the side of the housing left wall 210L. The developing housing 210 is provided with a pair of guide grooves 109A (FIG. 7). The guide grooves 109A are groove portions that are formed in the housing left wall 210L and the housing right wall 210R.

Further, referring to FIG. 7, the developing apparatus 20 is provided with a first transmission gear 211, a second transmission gear 212, and a third transmission gear 213. In addition, the printer 100 is provided with a first motor M1, a second motor M2, and a control part 500, which are provided in the casing 101. The first transmission gear 211, the second transmission gear 212, and the third transmission gear 213 are gears that are rotatably supported by the housing right wall 210R. The first transmission gear 211 is connected to the second transmission gear 212. In addition, the first transmission gear 211 is connected to the developing roller 21, the first stirring screw 23, and the second stirring screw 24 through a group of gears (not shown). When the developing apparatus 20 is loaded in the casing 101, the first motor M1 is connected to the third transmission gear 213, and the second motor M2 is connected to the first transmission gear 211.

The first motor M1 rotates a below-mentioned shaft 33 of the toner container 30 through the third transmission gear 213, thereby moving a below-mentioned moving wall 32 of the toner container 30. In the present embodiment, the first motor M1 is capable of being forwardly and reversely rotated. The second motor M2 rotates the developing roller 21, the first stirring screw 23, and the second stirring screw 24 of the developing apparatus 20 through the first transmission gear 211. Further, the second motor M2 rotates a below-mentioned stirring member 35 of the toner container 30 through the first transmission gear 211 and the second transmission gear 212. The control part 500 controls the first motor M1 and the second motor M2, respectively, in the printing operation, or the like, of the printer 100, driving the respective members of the developing apparatus 20 and the toner container 30.

<About Construction of Toner Container>

Figure 8A:
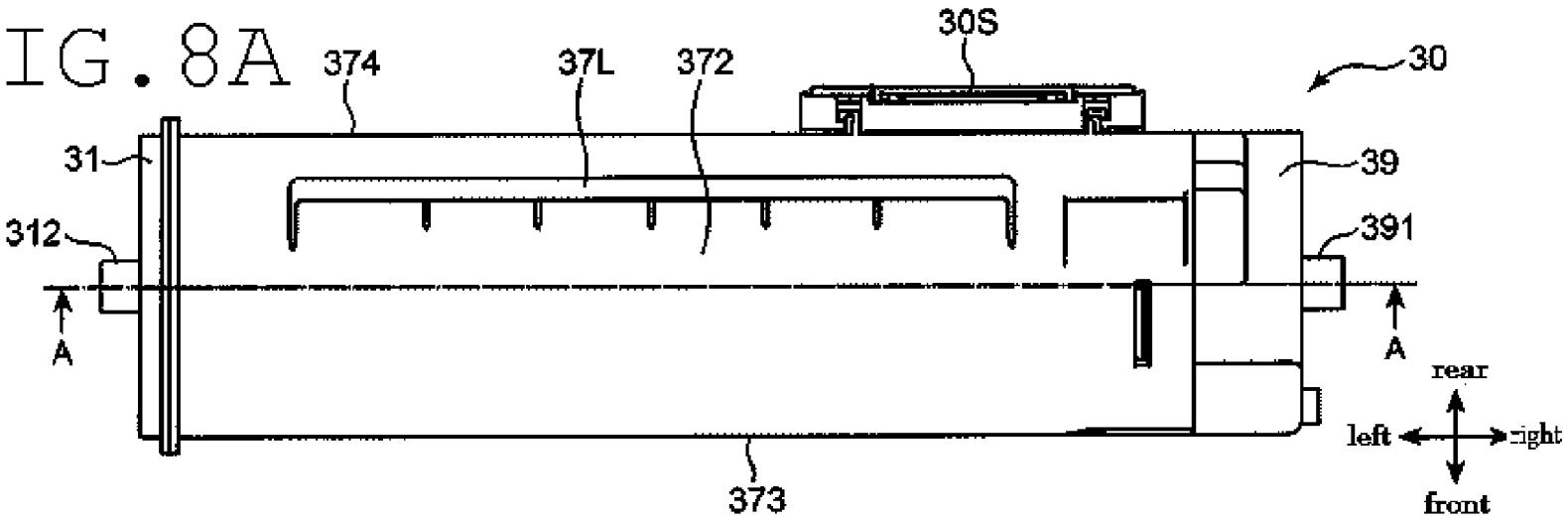
FIG. 8A is a plan view of the developer storing container according to one embodiment of the present disclosure.
Figure 8B:
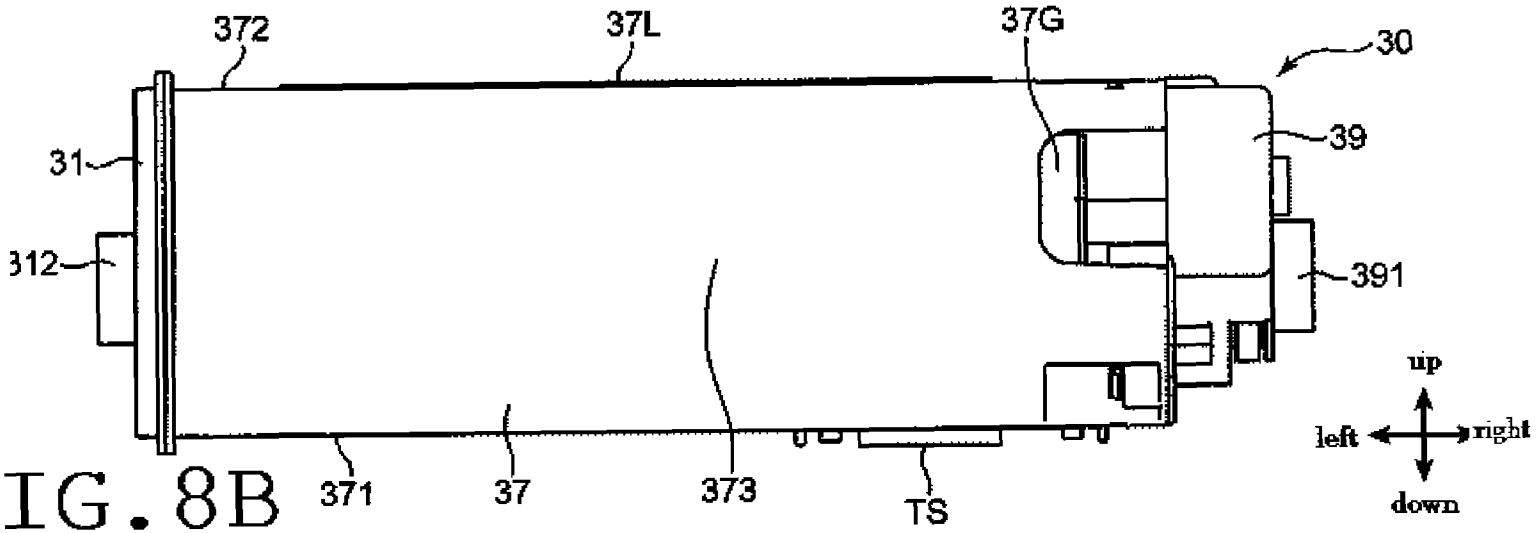
FIG. 8B is a front view of the developer storing container according to one embodiment of the present disclosure.
Figure 9:
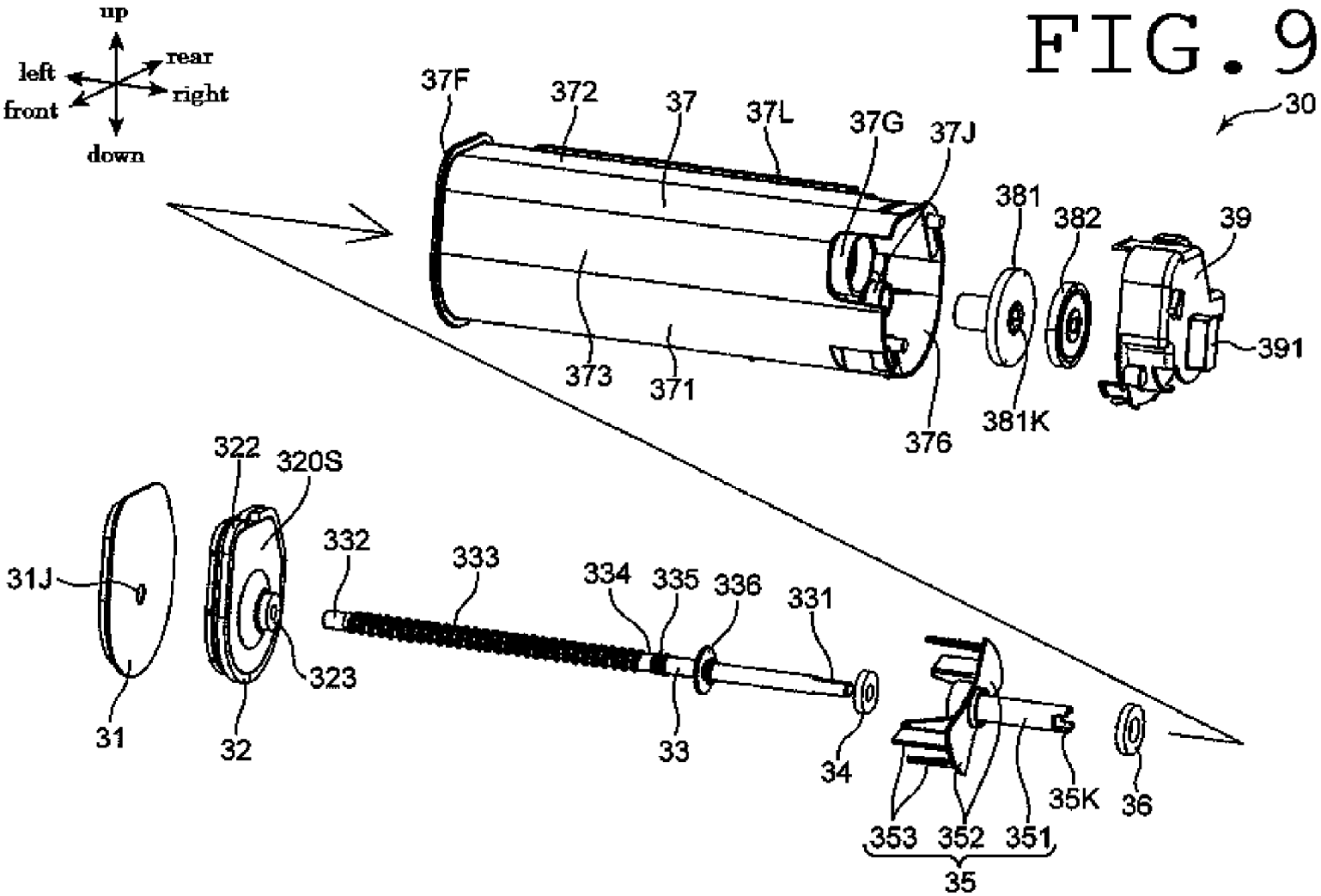
FIG. 9 is an exploded perspective view of the developer storing container according to one embodiment of the present disclosure.
Figure 10:
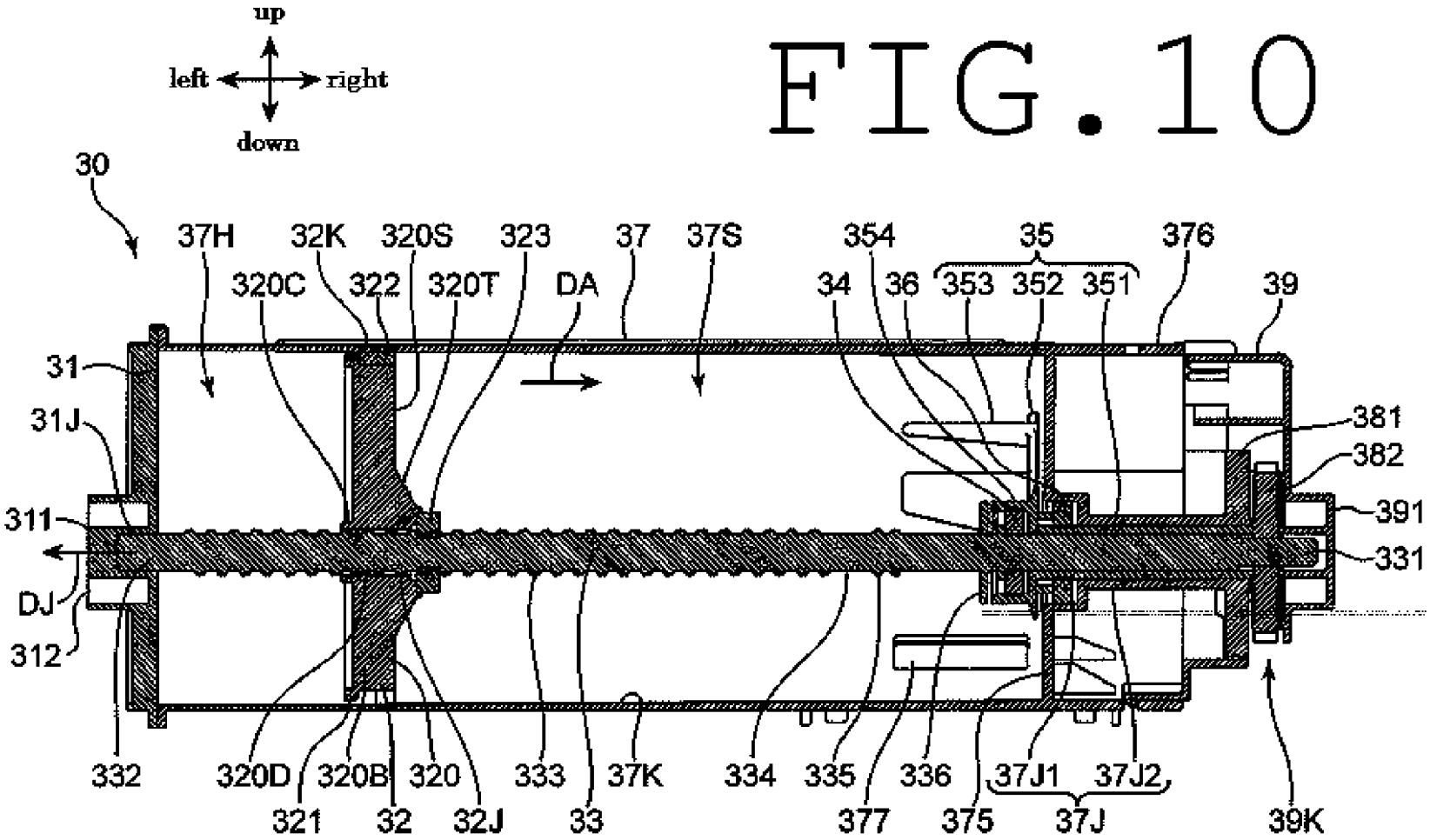
FIG. 10 is a sectional view of the developer storing container according to one embodiment of the present disclosure.
Figure 11:
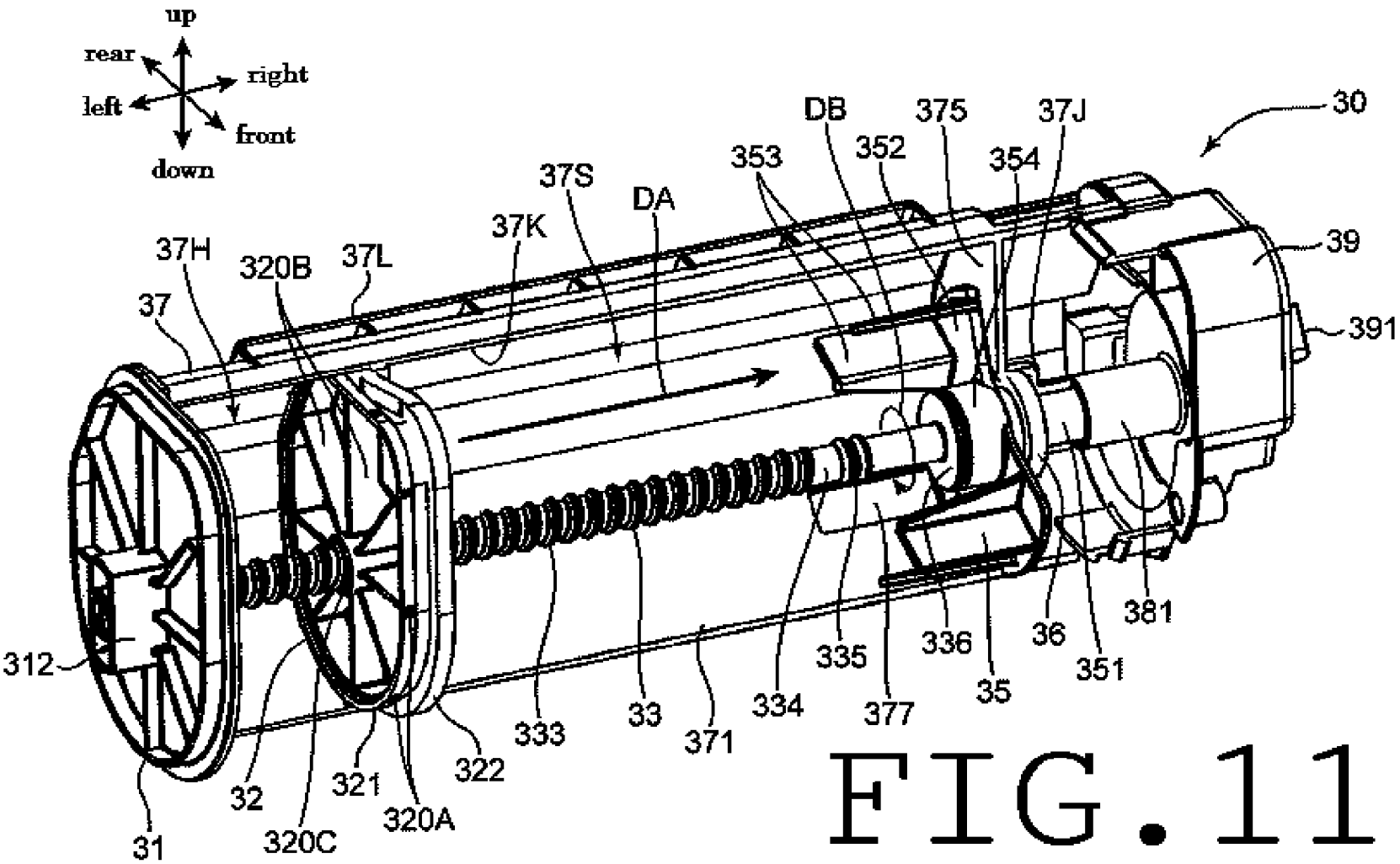
FIG. 11 is a perspective view showing how the inside of the developer storing container according to one embodiment of the present disclosure is constructed.
Figure 12:
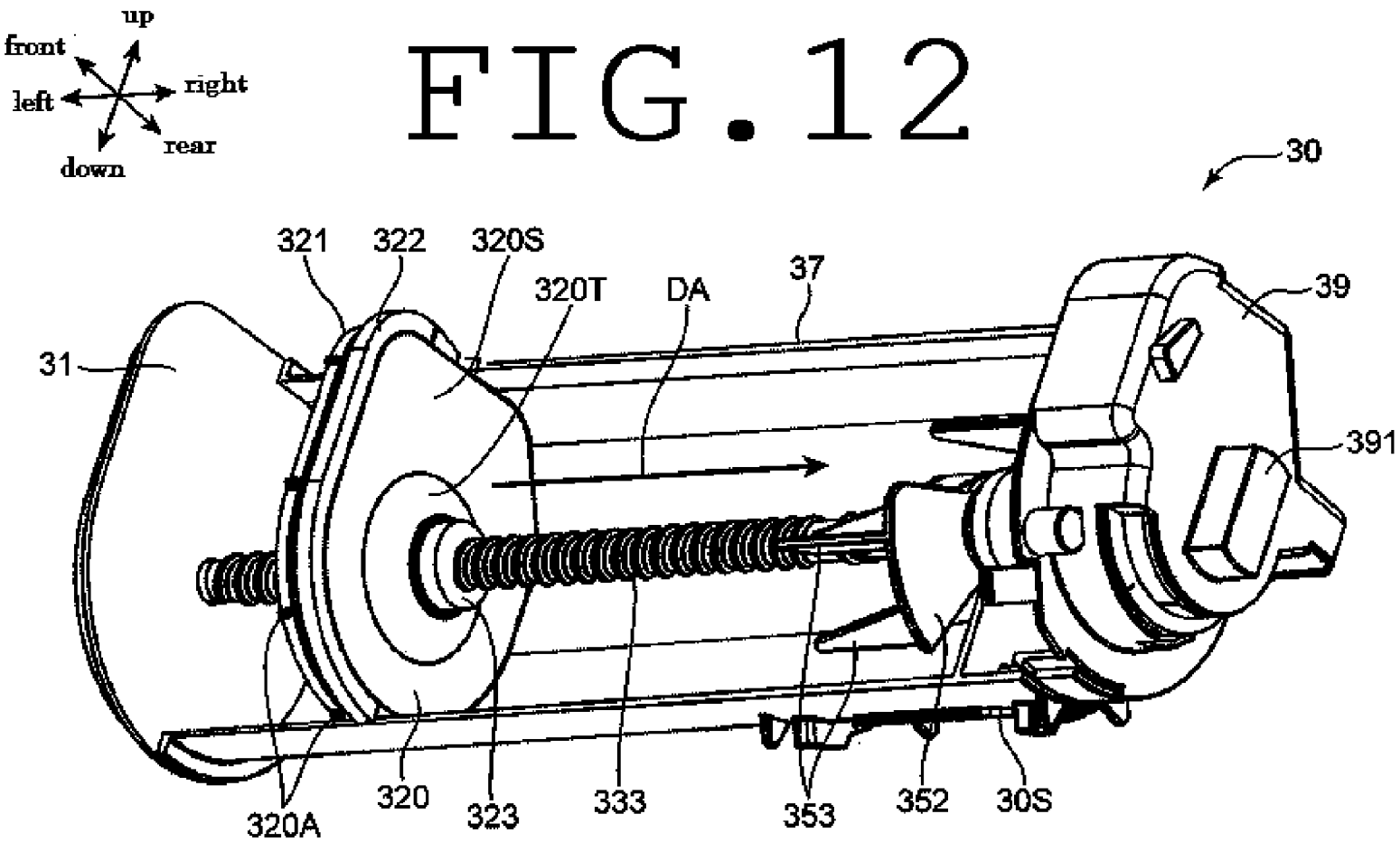
FIG. 12 is a perspective view showing how the inside of the developer storing container according to one embodiment of the present disclosure is constructed.
Figure 13A:
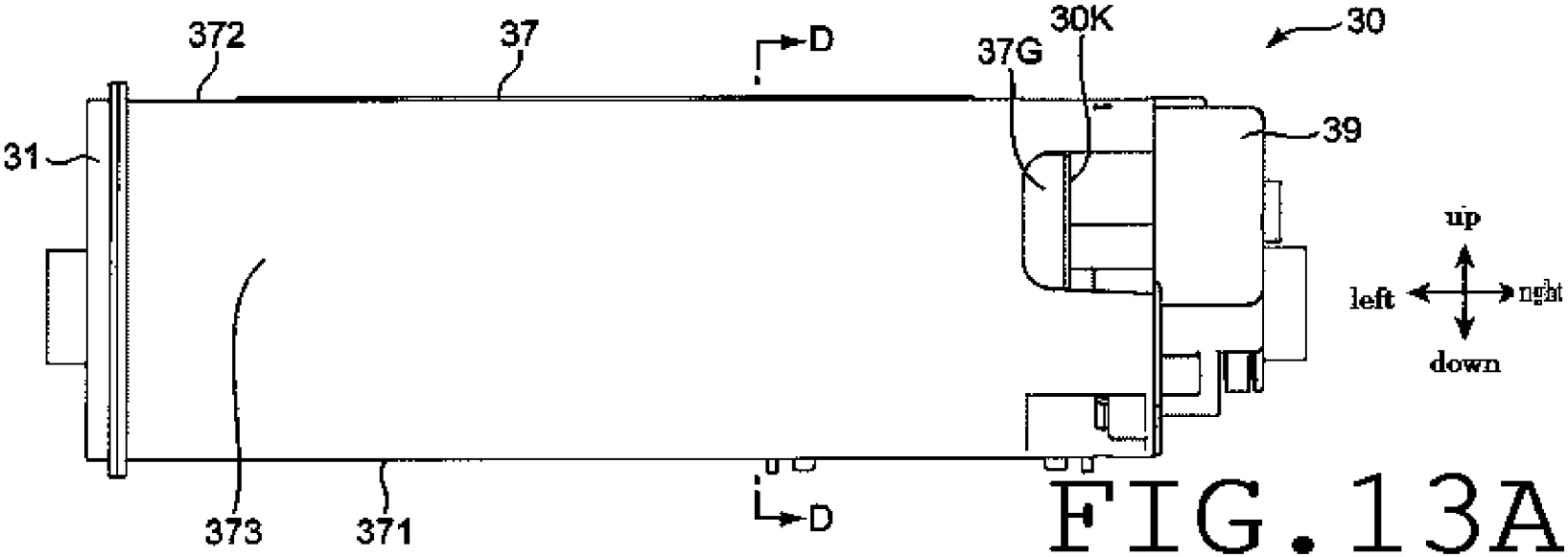
FIG. 13A is a front view of the developer storing container according to one embodiment of the present disclosure.
Figure 13B:
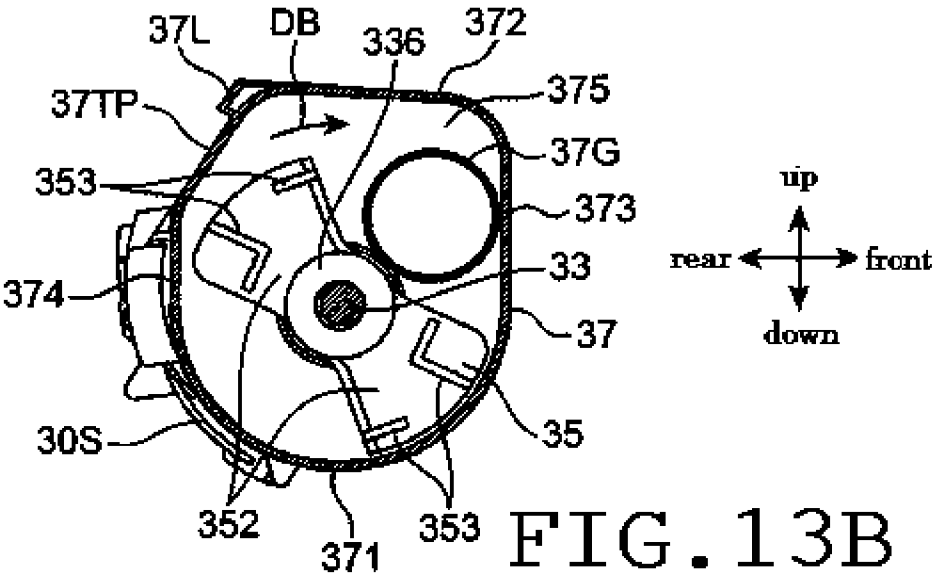
FIG. 13B is a sectional view of the developer storing container according to one embodiment of the present disclosure.
Figure 14A:
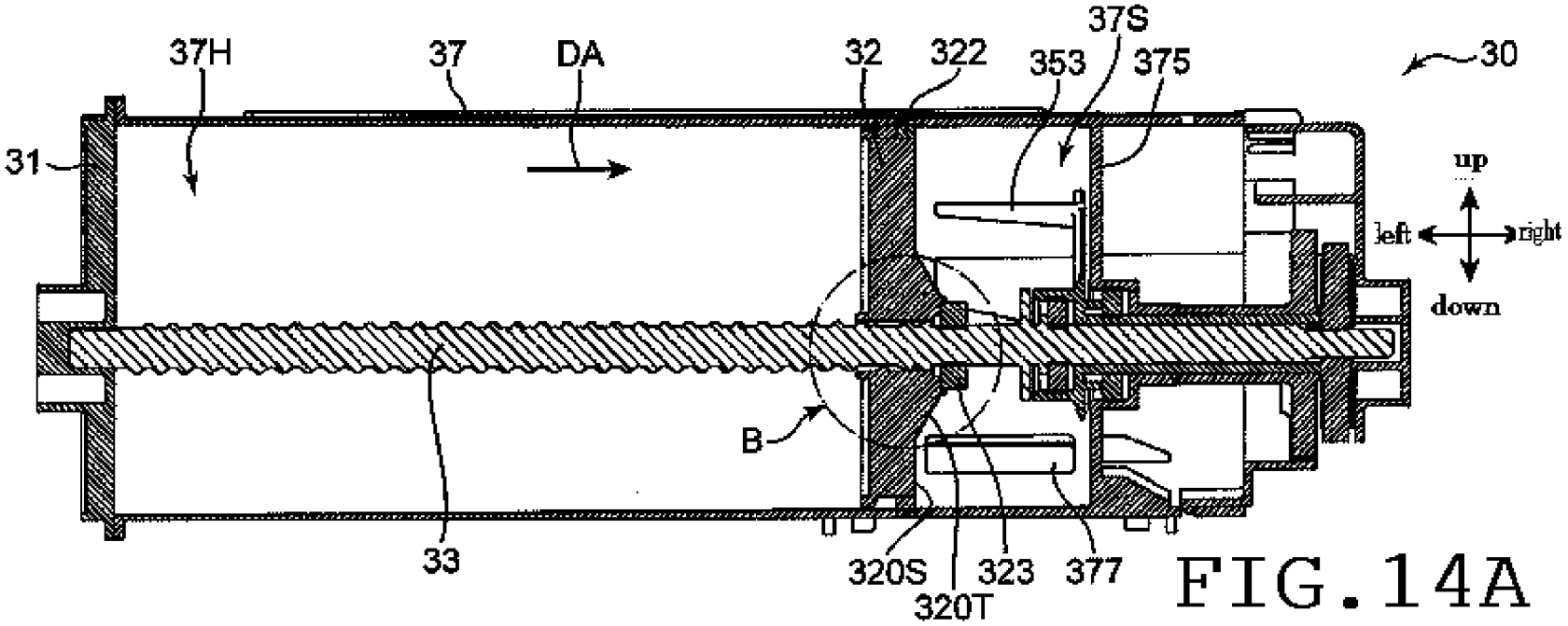
FIG. 14A is a sectional view of the developer storing container according to one embodiment of the present disclosure.
Figure 14B:
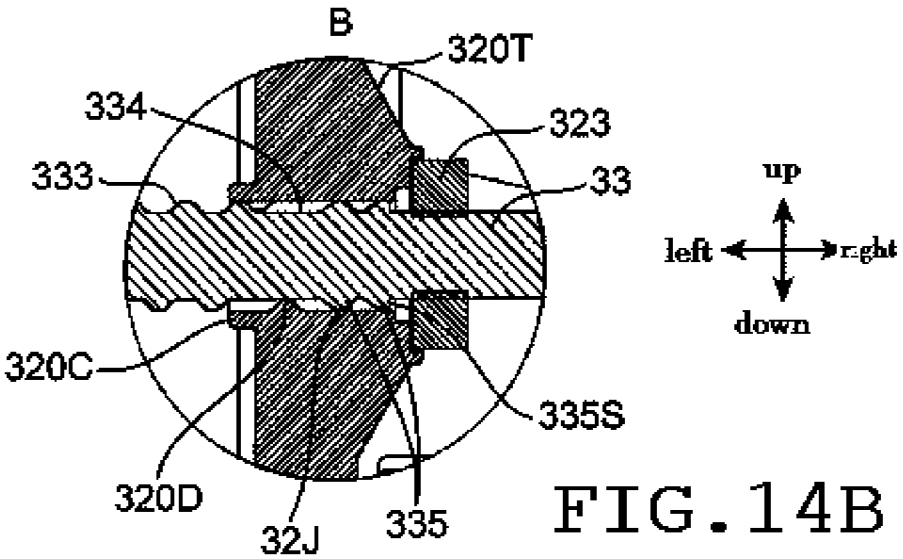
FIG. 14B is an enlarged sectional view of the developer storing container according to one embodiment of the present disclosure.

Next, referring to FIG. 8 to FIG. 14, the toner container 30 (the developer storing container) according to one embodiment of the present disclosure will be explained. FIG. 8A is a plan view of the toner container 30 according to the present embodiment. FIG. 8B is a front view of the toner container 30 according to the present embodiment. FIG. 9 is an exploded perspective view of the toner container 30. FIG. 10 is a sectional view of the toner container 30. FIG. 11 and FIG. 12 are perspective views showing how the inside of the toner container 30 according to the present embodiment is constructed. FIG. 11 and FIG. 12 are perspective views in which a below-mentioned container main body 37 of the toner container 30 is partially omitted. FIG. 13A is a front view of the toner container 30 according to the present embodiment. FIG. 13B is a sectional view of the toner container 30 according to the present embodiment. FIG. 14A is a sectional view of the toner container 30 according to the present embodiment. FIG. 14B is an enlarged sectional view of the toner container 30 according to the present embodiment.

The toner container 30 is formed in a cylindrical shape that extends in a lateral direction (a first direction, i.e., a direction of arrow DA in FIG. 10). The toner container 30 stores the replenishing toner (the developer) in the inside thereof. Referring to FIG. 9, the toner container 30 includes a lid part 31, a moving wall 32, a shaft 33, a first seal 34, a stirring member 35, a second seal 36, a container main body 37 (a container main body), a filling port cap 30K (FIG. 13A), a toner sensor TS (FIG. 8B), a first gear 381 (FIG. 9), a second gear 382, and a cover 39.

The lid part 31 (FIG. 9 and FIG. 10) is fixed to the container main body 37, sealing an opening part of the container main body 37. The lid part 31 is provided with a lid shaft hole part 31J, an abutting part 311, and a first guide part 312. The lid shaft hole part 31J is provided in the central part of the lid part 31, pivotally supporting the shaft 33 in a rotatable manner. The lid shaft hole part 31J is a hole part that is formed over a specific length in a leftward direction from a side face on the right side (an inner face part) of the lid part 31. The abutting part 311 corresponds to a bottom face part of the lid shaft hole part 31J. Against the abutting part 311, an end face of the shaft 33 is abutted. The first guide part 312 (FIG. 11) is a protruding part that is formed so as to extend in a vertical direction on a side face on the left side (an outer face part) of the lid part 31. The first guide part 312 has a function to guide the toner container 30 to be loaded onto the developing apparatus 20.

The container main body 37 is a main body portion of the toner container 30, being formed in a cylindrical shape. The container main body 37 is provided with an inner peripheral part 37K and an internal space 37H (FIG. 10 and FIG. 11). The inner peripheral part 37K is an inner peripheral face of the container main body 37, cylindrically extending along a longitudinal direction of the toner container 30 (a first direction, i.e., a direction of arrow DA in FIG. 10 and FIG. 11).

Figure 15:
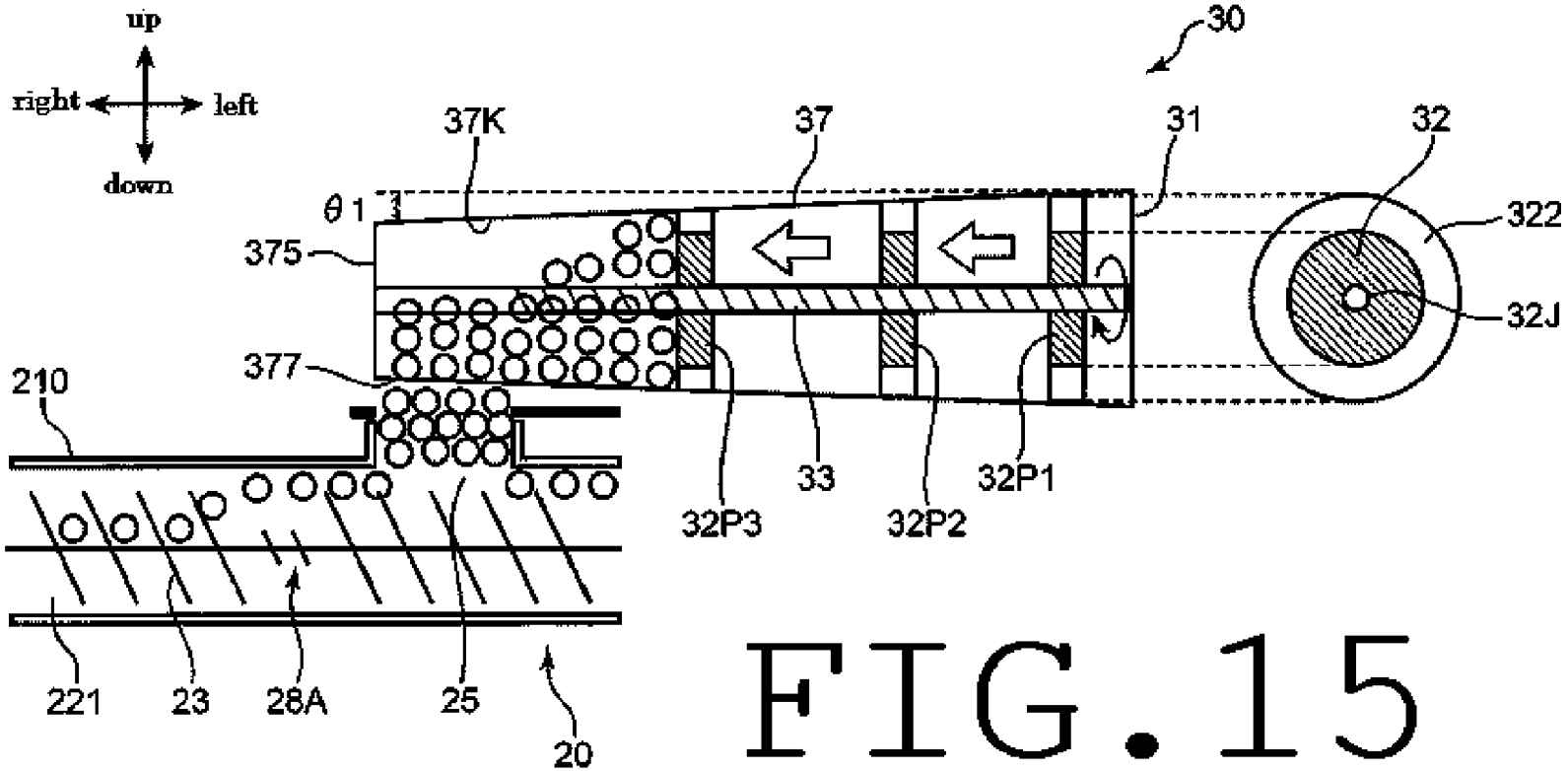
FIG. 15 is a schematic sectional view showing a tapered shape of an inner peripheral part of a container main body of the developer storing container according to one embodiment of the present disclosure.

In addition, referring to FIG. 8A and FIG. 8B, the container main body 37 is provided with a bottom part 371, a top plate 372, a front wall 373, a rear wall 374, a right wall 375 (FIG. 10) (a wall part), a main body flange part 37F (FIG. 9), and a protruding wall 376 (FIG. 9 and FIG. 10). The bottom part 371 is a bottom portion of the container main body 37, being formed in a semi-cylindrical shape protruding toward downward. In other words, when viewed from the section crossing with the first direction, the bottom part 371 is formed in a circular arc shape. The front wall 373 and the rear wall 374 are a pair of side walls that are erected toward upward from the side ends of the bottom part 371. The top plate 372 is disposed above the bottom part 371, covering the top of the internal space 37H. The right wall 375 is a wall part that blocks the container main body 37, being provided jointly with the other end side of the first direction (the right end side) of the bottom part 371, the front wall 373, the rear wall 374 and the top plate 372. The internal space 37H is a space that is defined by the inner peripheral part 37K, which is formed by the bottom part 371, the top plate 372, the front wall 373, and the rear wall 374, and further the right wall 375 and the lid part 31. In addition, in the internal space 37H, the region between the right wall 375 and the moving wall 32 provides a storing space 37S. The storing space 37S is a space in which the toner is stored in the inside of the toner container 30. As described below, the inner peripheral part 37K is slightly tapered along the first direction such that the cross-sectional area of the internal space 37H in the container main body 37 is decreased along the first direction (FIG. 15).

As shown in FIG. 10, the container main body 37 is opened on the opposite side of the first direction of the right wall 375. The main body flange part 37F is a portion that forms the opening part, having an outside diameter slightly larger than that of the left end part of the container main body 37. When the lid part 31 is fixed to the main body flange part 37F, the lid part 31 blocks the internal space 37H of the container main body 37. The outer peripheral edge of the lid part 31 is ultrasonic-welded to the main body flange part 37F.

Referring to FIG. 9 and FIG. 10, the protruding wall 376 is a portion where the outer peripheral part of the container main body 37 is protruded to the right side from the right wall 375. Onto the protruding wall 376, the cover 39 is loaded.

In addition, the container main body 37 is provided with the toner discharge port 377 (the developer discharge port), a shutter 30S, a holding part 37L, a filling port 37G, and a main body bearing part 37J. The toner discharge port 377 is an opening that is opened in a bottom face part of the container main body 37, being communicated with the inner peripheral part 37K. As shown in FIG. 10 and FIG. 11, the toner discharge port 377 is opened in a right end part (the first direction other end part) of the container main body 37. In other words, the toner discharge port 377 is disposed adjacent to the right wall 375 in the first direction. In addition, the toner discharge port 377 is opened in a rectangular shape, having a specific length along the first direction, and having a specific width along the circular arc shape of the bottom part 371. In the present embodiment, the toner discharge port 377 is opened in a location that is displaced to the rear side and upward along a circumferential direction from the lower end part of the bottom part 371.

The toner that has been stored in the storing space 37S is discharged from the toner discharge port 377 toward the developing apparatus 20. As described above, in the present embodiment, the internal space 37H of the container main body 37 is formed by the bottom part 371, the front wall 373, the rear wall 374, and the top plate 372. Therefore, the toner in the storing space 37S is collected by its own weight into the bottom part 371, which is formed in a circular arc shape, whereby the toner that is conveyed by the below-mentioned moving wall 32 can be efficiently discharged from the toner discharge port 377.

The shutter 30S (FIG. 6) is slidably disposed in the right end part of the container main body 37. The shutter 30S blocks (seals) the toner discharge port 377 from the outside of the container main body 37, and exposes the toner discharge port 377 to the outside. The slide movement of the shutter 30S is interlocked with the operation of loading the toner container 30 onto the developing apparatus 20.

The holding part 37L (FIG. 9) is a protrusion that is provided protrusively along the lateral direction in the rear side portion of the top plate 372 of the container main body 37. The holding part 37L is held by a user. The filling port 37G is formed in a cylindrical shape that is provided protrusively to the right side from the right wall 375. The cylindrical inside of the filling port 37G is formed so as to penetrate the right wall 375 along the first direction. The filling port 37G communicates between the outside of the container main body 37 and the storing space 37S. At the stage of manufacturing the toner container 30, the toner is filled into the storing space 37S from the filling port 37G.

The main body bearing part 37J is a bearing that is formed in the right wall 375. The main body bearing part 37J is formed in a cylindrical shape that is protruded rightward from the central part of the right wall 375. Referring to FIG. 10, the main body bearing part 37J is provided with a larger-diameter part 37J1 and a smaller-diameter part 37J2. The larger-diameter part 37J1 is a cylindrical part that is provided protrusively to the right side from the right wall 375. The smaller-diameter part 37J2 is connected to the right end part of the larger-diameter part 37J1, being a cylindrical part that is smaller in diameter than the larger-diameter part 37J1. Into the main body bearing part 37J, the shaft 33 is inserted. At this time, the right end side of the shaft 33 is protruded to the outside of the container main body 37. Further, in the cylindrical inside of the main body bearing part 37J, between the main body bearing part 37J and the shaft 33, a part of the stirring member 35 (a stirring bearing part 351) is inserted.

The filling port cap 30K (FIG. 13A) is loaded onto the filling port 37G of the container main body 37, sealing the filling port 37G. After the toner having been filled into the storing space 37S from the filling port 37G, the filling port cap 30K is loaded onto the filling port 37G, and welded thereto. As a result of this, the toner is prevented from being leaked from the filling port 37G.

The moving wall 32 is a wall part that is disposed, being faced to the first direction in the inside (the internal space 37H) of the container main body 37. The moving wall 32 defines an end face on the one end side of the first direction (a left end face) of the storing space 37S. An end face on the other end side of the first direction (a right end face) of the storing space 37S is defined by the right wall 375. In addition, the moving wall 32 has a function to move the toner in the inside of the internal space 37H in the first direction from an initial position on the one end side to a final position on the other end side of the first direction, while conveying the toner in the storing space 37S toward the toner discharge port 377, from the time of starting the use of the toner container 30 to the time of ending thereof. In the present embodiment, the initial position of the moving wall 32 is located on the right side of the lid part 31 (on the first direction downstream side), while the final position is located right on the left side (the first direction upstream side) of the toner discharge port 377.

Referring to FIG. 10 to FIG. 12, the moving wall 32 is provided with a conveying wall part 320, an outer peripheral wall part 321, a guide rib 320A (FIG. 12), an internal rib 320B (FIG. 11), a cylindrical part 320C, an inner wall seal 322 (a sealing member), a shaft seal 323, a bearing part 32J (FIG. 10), and an outer peripheral part 32K.

The conveying wall part 320 is a wall part that defines the storing space 37S together with the inner peripheral part 37K of the container main body 37. Particularly, the conveying wall part 320 is provided with a conveying face 320S, which is perpendicular to the shaft 33. The conveying face 320S conveys the toner inside of the storing space 37S, while pressing it, as the moving wall 32 is moved. In the present embodiment, the conveying face 320S is provided with a tapered face 320T (FIG. 10 and FIG. 12).

The bearing part 32J is a bearing part that is formed substantially in the central part of the conveying wall part 320. The bearing part 32J is moved along the first direction while holding the moving wall 32. The below-described shaft 33 is inserted into this bearing part 32J.

The cylindrical part 320C is a cylindrical portion of the conveying wall part 320 that is provided protrusively to the first direction upstream side from a face on the opposite side of the conveying face 320S. The cylindrical part 320C forms a part of the bearing part 32J. The cylindrical part 320C is provided with a female spiral part 320D. The female spiral part 320D is a spiral-shaped screw part that is formed on the inner circumferential face of the cylindrical part 320C. The female spiral part 320D has a function to move the moving wall 32 along the first direction by engaging with a below-mentioned male spiral part 333 of the shaft 33.

The outer peripheral wall part 321 is a wall part that is provided protrusively from the entire outer peripheral edge of the conveying wall part 320 toward the opposite side of the storing space 37S, i.e., the moving direction upstream side (the first direction upstream side) of the moving wall 32. The outer peripheral wall part 321 is disposed, being opposed to the inner peripheral part 37K of the container main body 37. The guide rib 320A is a rib member that is extendedly provided along the first direction on the outer peripheral wall part 321. A plurality of guide ribs 320A are disposed on the peripheral face of the outer peripheral wall part 321 at intervals in a circumferential direction of rotation of the shaft 33. The guide rib 320A has a function to slightly contact with the inner peripheral part 37K of the container main body 37, thus suppressing the moving wall 32 from being inclined with respect to the shaft 33 in the inside of the container main body 37. The internal rib 320B is a rib that connects between the outer circumferential face of the cylindrical part 320C and the inner peripheral face of the outer peripheral wall part 321 as shown in FIG. 11. A plurality of internal ribs 320B are disposed along the circumferential direction.

The inner wall seal 322 is a sealing member that is disposed on the side of the conveying wall part 320 of the outer peripheral wall part 321 so as to cover the periphery of the conveying wall part 320. The inner wall seal 322 is an elastic member that is formed of an urethane sponge. The inner wall seal 322 is compressively deformed between the inner peripheral part 37K of the container main body 37 and the moving wall 32. In addition, the inner wall seal 322 forms the outer peripheral part 32K of the moving wall 32. The outer peripheral part 32K is disposed, being tightly contacted with the inner peripheral part 37K of the container main body 37. The inner wall seal 322 prevents the toner in the storing space 37S from flowing out from between the inner peripheral part 37K of the container main body 37 and the moving wall 32 to the moving direction upstream side of the moving wall 32. The above-mentioned guide rib 320A is disposed on the first direction upstream side of the inner wall seal 322.

The shaft seal 323 is fixed on the distal end side of the moving direction of the moving wall 32 of the female spiral part 320D in the bearing part 32J (FIG. 10). The shaft seal 323 is an elastic member that is formed of an urethane sponge. The shaft seal 323 is contacted with the male spiral part 333 earlier than the female spiral part 320D to clean the toner that has been stuck to the male spiral part 333. Therefore, it is suppressed that the toner is aggregated between the male spiral part 333 and the female spiral part 320D, whereby stable movement of the moving wall 32 can be achieved. In addition, the shaft seal 323 has a ring shape, thereby being tightly contacted with the shaft 33 over the entire circumference of the shaft 33. Therefore, it is prevented that the toner in the storing space 37S flows out to the moving direction upstream side of the moving wall 32, passing through the bearing part 32J.

The shaft 33 is rotatably supported by the right wall 375 and the lid part 31 of the container main body 37 so as to extend in the first direction in the internal space 37H. The shaft 33 is provided with a first shaft end part 331, a second shaft end part 332, a male spiral part 333, a moving wall stopping part 334, a moving wall supporting part 335, and a shaft flange 336.

Referring to FIG. 9 and FIG. 10, the first shaft end part 331 is a distal end part of the shaft 33 that penetrates the main body bearing part 37J, being protruded to the right side. As shown in FIG. 9, on the peripheral face of the first shaft end part 331, a pair of D faces are formed. With the first shaft end part 331, a second gear 382, which is provided with a D-hole shape in the central part, is engaged. As a result of this, the shaft 33 and the second gear 382 are made integrally rotatable. The second shaft end part 332 is a left end part of the shaft 33. The second shaft end part 332 is pivotally supported by the lid shaft hole part 31J, which is formed in the lid part 31.

The male spiral part 333 is a spiral-shaped screw part that is formed on the outer circumferential face of the shaft 33 in the internal space 37H. As shown in FIG. 10, in the present embodiment, the male spiral part 333 is disposed from a region of the shaft 33 that is adjacent to the lid part 31 to a region that is on the upstream side of the toner discharge port 377 in the first direction (the direction of arrow DA in FIG. 10).

The moving wall stopping part 334 is disposed consecutively to the male spiral part 333 on the first direction downstream side thereof. The moving wall stopping part 334 is a region where the male spiral part 333 is partially lost from the shaft 33 in the internal space 37H to provide only the shaft portion. The moving wall stopping part 334 is located above the toner discharge port 377, and on the first direction upstream side of the toner discharge port 377.

The moving wall supporting part 335 is disposed on the first direction downstream side of the moving wall stopping part 334. The moving wall supporting part 335 is a protruding part that is provided protrusively in a radial direction from the circumferential face of the shaft 33. The moving wall supporting part 335 has a function to support the bearing part 32J when the moving wall 32 has reached the final position, thus suppressing the conveying face 320S of the moving wall 32 from being inclined with respect to the first direction (inclined with respect to the shaft 33).

The shaft flange 336 is disposed on the first direction downstream side of the moving wall supporting part 335 with a spacing being given therebetween. The shaft flange 336 is a disk-like flange that is provided protrusively in a radial direction from the circumferential face of the shaft 33. Two shaft flanges 336 are disposed so as to be adjacent to each other in the first direction. The shaft flange 336 on the downstream side has a function to compress the first seal 34 (FIG. 10) together with a below-mentioned stirring cylindrical part 354 of the stirring member 35 (FIG. 11). On the other hand, the shaft flange 336 on the upstream side has a function to suppress the toner from getting in the inside of the stirring cylindrical part 354.

The first seal 34 is a ring-shaped sealing member that is disposed, being compressed between the shaft flange 336 of the shaft 33 and a side face of the stirring cylindrical part 354 of the stirring member 35, as described above. The first seal 34 is formed of a sponge material. The first seal 34 prevents the toner from being leaked to the outside of the container main body 37, passing between the inner circumferential face of the stirring bearing part 351 (FIG. 10) of the stirring member 35 and the circumferential face of the shaft 33.

The stirring member 35 (FIG. 9 and FIG. 10) is disposed above the toner discharge port 377 along the right wall 375. The stirring member 35 stirs the toner in the storing space 37S, and delivers the toner from the toner discharge port 377. In the present embodiment, the stirring member 35 is rotated around the shaft 33 and relatively to the shaft 33. In FIG. 11, the stirring member 35 is rotated in a direction of arrow DB. The stirring member 35 is provided with a stirring bearing part 351, a stirring supporting part 352, a stirring blade 353, and a stirring cylindrical part 354 (FIG. 10 and FIG. 11).

The stirring bearing part 351 is formed in a cylindrical shape that is fitted over the shaft 33. The stirring bearing part 351 is inserted from the side of the storing space 37S of the container main body 37 into the main body bearing part 37J. As a result of this, the right end side of the stirring bearing part 351 is penetrated through the main body bearing part 37J to be exposed to the outside of the container main body 37 beyond the right wall 375 (the main body bearing part 37J). On the other hand, the left end side of the stirring bearing part 351 is disposed inside of the storing space 37S. In the right end part of the stirring bearing part 351, a first engaging part 35K is formed (FIG. 9). The first engaging part 35K is engaged with a second engaging part 381K, which is formed on the inner peripheral face of the first gear 381. As a result of this, the stirring member 35 and the first gear 381 are integrally rotated.

The stirring supporting part 352 is a protruding piece that is provided protrusively in a radial direction of the shaft 33 from the left end side of the cylindrical stirring bearing part 351. The stirring supporting part 352 is disposed along the right wall 375, being faced to the first direction. The stirring supporting part 352 is rotated around the shaft 33 in the storing space 37S. Particularly, in the present embodiment, a pair of stirring supporting parts 352 are disposed. In other words, one stirring supporting part 352 is disposed along the right wall 375 so as to extend radially toward the outside of the shaft 33. In addition, the other stirring supporting part 352 is disposed so as to extend radially toward the outside from a location different from that of the above-mentioned one stirring supporting part 352 in a circumferential direction. In other words, the pair of stirring supporting parts 352 are disposed so as to extend toward the sides opposite to each other in a radial direction, being provided with a propeller shape in which the width in a circumferential direction is set to be increased in a radial direction toward the outside. Therefore, as compared to the case where the stirring supporting part 352 is formed in a disk shape, the toner that gets in the clearance between the stirring supporting part 352 and the right wall 375 is easy to be moved, thereby the toner being prevented from being aggregated.

The stirring blade 353 is a blade member that is provided protrusively from a pair of stirring supporting parts 352 toward the left side (the first direction upstream side). As shown in FIG. 11 and FIG. 12, two stirring blades 353 are provided protrusively from each stirring supporting part 352. The stirring blade 353 is provided with an L shape in a sectional view intersecting perpendicularly with the axial direction of the shaft 33 (see FIG. 13B). The stirring blade 353 orbits above the toner discharge port 377, while stirring the toner around the toner discharge port 377, and discharging the toner from the toner discharge port 377.

The stirring cylindrical part 354 is a portion of the stirring bearing part 351 that is on the left side of the stirring supporting part 352. The outside diameter of the stirring cylindrical part 354 is set to be larger than the outside diameter of the stirring bearing part 351 on the right side of the stirring supporting part 352. As shown in FIG. 10, in the inside of the stirring cylindrical part 354, the first seal 34 is disposed, being compressed.

Referring to FIG. 13A and FIG. 13B, in the present embodiment, when the right wall 375 is viewed from the first direction upstream side (the left side, i.e., this side of a paper face on FIG. 13B), the stirring member 35 is provided with a shape that causes the filling port 37G to be exposed in a specific turned position of the stirring member 35 around the shaft 33. More specifically, as shown in FIG. 13B, when the stirring member 35 is disposed in a specific turned position around the shaft 33, the filling port 37G is exposed between one stirring supporting part 352 and the other stirring supporting part 352 in a circumferential direction. Therefore, even if the stirring member 35 is made capable of being rotated in any position along the right wall 375, by adjusting the turned position of the stirring member 35 as shown in FIG. 13B, the toner can be smoothly filled into the storing space 37S through the filling port 37G.

The second seal 36 (FIG. 9 and FIG. 10) is a ring-shaped sealing member that is disposed in the inside of the larger-diameter part 37J1 of the container main body 37. The second seal 36 is disposed, being compressed between a stepped part between the larger-diameter part 37J1 and the smaller-diameter part 37J2 of the main body bearing part 37J, and a ring-shaped protrusion that is formed on a right side face of the stirring supporting part 352 of the stirring member 35. The second seal 36 is formed of a sponge material. The second seal 36 prevents the toner from being leaked to the outside of the container main body 37, passing between the outer circumferential face of the stirring bearing part 351 of the stirring member 35 and the inner circumferential face of the main body bearing part 37J.

The first gear 381 transmits a rotational driving force to the stirring member 35. The first gear 381 is connected to the second motor M2 through the first transmission gear 211 and the second transmission gear 212 of the developing apparatus 20 (FIG. 7). In the present embodiment, the first gear 381 is rotationally driven in synchronization with the developing roller 21, the first stirring screw 23, and the second stirring screw 24 of the developing apparatus 20. The first gear 381 is connected to the stirring bearing part 351 of the stirring member 35, which has penetrated the main body bearing part 37J. As a result of this, the first gear 381 and the stirring member 35 are integrally rotated. On the circumferential face of the first gear 381, a plurality of gear teeth are provided.

The second gear 382 transmits a rotational driving force to the shaft 33. Also on the circumferential peripheral face of the second gear 382, a plurality of gear teeth are provided. The second gear 382 is connected to the first motor M1 through the third transmission gear 213 (FIG. 7). As shown in FIG. 10, the right end part of the shaft 33 is disposed so as to penetrate the stirring bearing part 351 of the stirring member 35. The second gear 382 is connected (fixed) to the distal end part (the first shaft end part 331) of the shaft 33, which has penetrated the stirring bearing part 351.

The cover 39 is loaded onto the protruding wall 376 of the container main body 37. The cover 39 has a function to expose a part of the first gear 381 and the second gear 382 in a circumferential direction to the outside, and to cover the other portion of the first gear 381 and the second gear 382 in the circumferential direction. Referring to FIG. 10, the cover 39 is provided with a second guide part 391 and an opening part for gear 39K.

The second guide part 391 is a protruding part that is provided protrusively to the right side along a vertical direction on a side face on the right side of the cover 39. The second guide part 391 has a function to guide the toner container 30 to be loaded onto the developing apparatus 20 together with the first guide part 312 of the lid part 31.

The opening part for gear 39K is an opening part with which a bottom face part of the cover 39 is opened in a semi-circular arc shape. With the cover 39 being loaded onto the container main body 37, a part of the gear teeth of the first gear 381 and the second gear 382 is exposed to the outside of the toner container 30 through the opening part for gear 39K. As a result of this, when the toner container 30 is loaded into the developing housing 210 of the developing apparatus 20, the first gear 381 and the second gear 382 are engaged with an electromagnetic clutch that is connected to the second transmission gear 212, and the third transmission gear 213 (FIG. 7), respectively.

The toner sensor TS (FIG. 8B) is a sensor that is disposed in the bottom part 371 of the container main body 37. The toner sensor TS is disposed adjacent to the toner discharge port 377 in a circumferential direction, and in the present embodiment, is fixed to the lowest face part of the bottom part 371. The toner sensor TS is a sensor comprised of a magnetic permeability sensor or a piezoelectric element. In the case where the toner sensor TS is comprised of a piezoelectric element, a sensor portion of the toner sensor TS is exposed to the storing space 37S. The toner sensor TS outputs a HIGH signal (+5V) when being pressed by the toner in the storing space 37S. In addition, if there is practically no toner on the toner sensor TS, the toner sensor TS outputs a LOW signal (0V). The output signal of the toner sensor TS is referenced by the control part 500 (FIG. 7). In the case where the toner sensor TS is a magnetic permeability sensor, the sensor need not be directly contacted with the toner. Therefore, in another embodiment, the toner sensor TS may be disposed on the side of the developing housing 210 of the developing apparatus 20 so as to be opposed to the outside wall of the container main body 37. Further, the location of the toner sensor TS is not limited to the bottom part 371. In another embodiment, the toner sensor may be disposed on such a part as the top plate 372, the front wall 373, or the rear wall 374 of the container main body 37.

<About Movement of Moving Wall>

While the first guide part 312 of the lid part 31 and the second guide part 391 of the cover 39 being guided by the pair of guide grooves 109A of the developing apparatus 20, the toner container 30 is loaded into the container accommodating part 109 by the user (FIG. 6 and FIG. 7). When the toner container 30 is loaded into the container accommodating part 109, the shutter 30S is moved, the toner discharge port 377 being opened. As a result of this, the toner discharge port 377 is disposed above the toner replenishing port 25, being opposed thereto (FIG. 4 and FIG. 5).

FIG. 14A is a sectional view showing the state in which the moving wall 32 has been positioned in a final position in the toner container 30. FIG. 14B is an enlarged sectional view showing the state in which the moving wall 32 has been positioned in the final position in the toner container 30. FIG. 10, which is given above, is a sectional view showing the state in which the moving wall 32 has been moved half way from the initial position in the first direction. The initial position of the moving wall 32 is set at a position along the lid part 31, i.e., on the left side of the position of the moving wall 32 that is shown in FIG. 10.

When a new toner container 30 is loaded onto the printer 100, the control part 500 (FIG. 7) drives the first motor M1 to rotationally drive the shaft 33 through the second gear 382, which is engaged with the third transmission gear 213. As a result of this, on the basis of the engagement of the male spiral part 333 of the shaft 33 with the female spiral part 320D of the moving wall 32, the moving wall 32 is moved toward the toner discharge port 377 in the first direction (a direction of arrow DA in FIG. 10). Then, when the moving wall 32 has been moved rightward from the initial position by a specific distance, the storing space 37S is filled with the toner, the toner sensor TS outputting a HIGH signal according to the filled state. The control part 500 stops the moving wall 32 in response to the HIGH signal that has been outputted by the toner sensor TS.

In the present embodiment, when viewed from the section crossing with the first direction, the inner peripheral part 37K of the container main body 37 and the outer peripheral part 32K of the moving wall 32 are in a non-complete round shape. In addition, the outer peripheral part 32K of the moving wall 32, which is tightly contacted with the inner peripheral part 37K of the container main body 37, is provided with a shape analogous to the inner peripheral part 37K. Therefore, even in the case where, on the basis of the engagement of the male spiral part 333 with the female spiral part 370D, the moving wall 32 is provided with a rotational force around the shaft 33, it is prevented that the moving wall 32 is rotated (co-rotated) around the shaft 33. As a result of this, with the rotational driving force of the first motor M1, the moving wall 32 can be moved in a stable manner in the first direction.

As described above, in the present embodiment, as shown in FIG. 5, the toner replenishing form of volume replenishment type has been adopted. Therefore, in the case where the retaining part 29 (FIG. 5) on the side of the developing apparatus 20 seals the toner replenishing port 25 from under, the replenishing toner will not be dropped from the toner container 30. On the other hand, when the toner is supplied from the developing roller 21 to the photosensitive drum 121 of the developing apparatus 20, thereby the quantity of the toner in the retaining part 29 being decreased, the toner will flow into the developing apparatus 20 from the toner discharge port 377 through the toner replenishing port 25. As a result of this, in the storing space 37S of the toner container 30, the toner around the toner sensor TS is lost, thereby the toner sensor TS outputting a LOW signal. In response to the signal, the control part 500 drives the first motor M1 to further move the moving wall 32 toward the toner discharge port 377 until the toner sensor TS outputs a HIGH signal.

In accordance with the developing operation in the developing apparatus 20, the control part 500 drives the second motor M2 to rotationally drive the developing roller 21, and the like. In interlocking with this rotational operation, the stirring member 35 is rotated through the first gear 381, which is engaged with the second transmission gear 212. As a result of this, the stirring member 35, which is disposed on the right end side of the storing space 37S is rotated around the shaft 33, thereby the toner above the toner discharge port 377 being stirred in a stable manner. Therefore, the fluidity of the toner is increased, and thus the toner is dropped from the toner discharge port 377 in a stable manner. Particularly, in the present embodiment, the stirring blade 353 is provided protrusively from the stirring supporting part 352 of the stirring member 35. Therefore, by the orbiting motion of the stirring blade 353, the toner around the toner discharge port 377 is positively stirred.

When the printing operation is repeated, thereby the toner in the storing space 37S in the toner container 30 being continued to be used, the moving wall 32 will eventually reach the final position shown in FIG. 14A. In this way, with the moving wall 32 being gradually moved in the first direction, the toner in the storing space 37S is conveyed to the toner discharge port 377, while being pressed by the moving wall 32. At this time, until the moving wall 32 reaches the final position, the storing space 37S is gradually reduced. Therefore, in the inside of the toner container 30, the space itself in which the toner remains is gradually lost. As a result of this, in comparison with a typical toner container with which the volume of the storing space will not be changed, the quantity of toner that remains in the storing space 37S in the container main body 37 at the time of termination of the use is reduced.

In the present embodiment, as shown in FIG. 14A, the final position of the moving wall 32 where the moving wall 32 is stopped is set slightly on the first direction upstream side of the toner discharge port 377. More specifically, referring to FIG. 14B, when, with the moving wall 32 being moved, the bearing part 32J of the moving wall 32 reaches the moving wall stopping part 334, the engagement of the male spiral part 333 with the female spiral part 320D is released. As a result of this, transmission of the moving force from the shaft 33 to the moving wall 32 is interrupted, the moving wall 32 being stopped in the final position. At this time, there is left a space above the toner discharge port 377, a slight quantity of toner remains in that space. However, in the present embodiment, with the stirring member 35 being rotationally driven, the toner can be discharged from the toner discharge port 377 in a stable manner to the last. The toner discharge port 377 is opened in a location that is displaced slightly upward from the lower end part of the container main body 37. Even in such a case, the toner remaining in the lowest end part of the container main body 37 will be scooped up by the stirring blade 353 (FIG. 11), and then discharged from the toner discharge port 377 in a stable manner.

Further, referring to FIG. 14A, in the final position of the moving wall 32, the conveying face 320S of the moving wall 32 is located with a spacing being provided on the first direction upstream side with respect to the stirring blade 353 of the stirring member 35. Therefore, it is prevented that there occurs an interference between the conveying face 320S of the moving wall 32, which has reached the final position, and the stirring member 35. In addition, in the final position of the moving wall 32 that is shown in FIG. 14A, the inner wall seal 322 of the moving wall 32 urges the inner peripheral part 37K of the toner container 30 in the radial direction from the inside with an elastic force. Therefore, the moving wall 32 is locked in the final position in a stable manner, thus the moving wall 32 being prevented from approaching the side of the stirring member 35. In another embodiment, the stirring member 35 may not be provided with the stirring blade 353, and the final position of the moving wall 32 may be set such that the moving wall 32 blocks the toner discharge port 377 from the inside.

Further, FIG. 15 is a schematic sectional view for explaining the tapered shape of the inner peripheral part 37K of the container main body 37 of the toner container 30 according to the present embodiment. In FIG. 15, a part of the toner container 30 and that of the developing apparatus 20 are shown. In addition, in order to simplify the explanation, in FIG. 15, the shape of a cross section orthogonal to the first direction of the moving wall 32 is assumed to be circular. Actually, the cross sectional shape of the moving wall 32 is substantially a polygonal shape as shown in FIG. 11 and FIG. 12. In addition, in FIG. 15, the initial position of the moving wall 32 is indicated with a symbol 32P1, and it is shown that, with the moving wall 32 being moved in the first direction, the moving wall 32 is sequentially moved to the positions indicated with symbols 32P2 and 32P3. In addition, in FIG. 15, the conveying capacity suppressing part in the developing apparatus 20 is formed by the first spiral blade 23*b* of the first stirring screw 23 being partially reduced in size (a size-reduction part 28A). Even in this case, as with the suppressing paddle 28 (FIG. 5), the retaining part 29 for toner is formed around the toner replenishing port 25. The size-reduction part 28A may be formed by partially removing the first spiral blade 23*b*.

In the present embodiment, as shown in FIG. 15, the cross-sectional area of the internal space 37H of the container main body 37 in a sectional view intersecting perpendicularly with the first direction (see the arrow in FIG. 15) is set so as to be decreased as the final position of the moving wall 32 is approached. Particularly, the cross-sectional area of the internal space 37H is set so as to be decreased along the first direction from the initial position to the final position of the moving wall 32. For this change in cross-sectional area of the internal space 37H, the outer peripheral part of the container main body 37 and the inner peripheral part 37K thereof are slightly tapered from the left end part to the right end part of the container main body 37.

When, with the use of the toner container 30, the moving wall 32 is moved in the first direction, the inner peripheral part 37K of the container main body 37 and the inner wall seal 322 of the moving wall 32 rub each other. Therefore, there is the possibility that the sealability of the inner wall seal 322 may be gradually lowered. Even in such a case, according to the configuration as described above, the inner peripheral part 37K of the container main body 37 is disposed such that the distance between it and the axis of the shaft 33 is gradually reduced along the first direction. As a result of this, as the moving wall 32 is moved from the side of the lid part 31 to that of the right wall 375, the amount of compression of the inner wall seal 322 is increased along the first direction, thereby the sealability of the inner wall seal 322 being maintained in a stable manner. Therefore, the toner in the storing space 37S is suppressed from being leaked from between the inner peripheral part 37K and the inner wall seal 322 to the internal space 37H on the first direction upstream side of the moving wall 32. Particularly, in the present embodiment, the cross-sectional area of the internal space 37H is set so as to be decreased from the initial position to the final position of the moving wall 32 along the first direction. Therefore, the amount of compression of the inner wall seal 322 can be gradually (continuously) increased as the moving wall 32 is moved.

Referring to FIG. 15, it is desirable that the taper angle θ1 of the inner peripheral part 37K be set in the range of 0.5 degrees to 10 degrees, and more desirably, the taper angle θ1 is set in the range of 1 degree to 5 degrees. If the taper angle θ1 exceeds 10 degrees, the amount of compression of the inner wall seal 322 is large, thereby the frictional force between the inner peripheral part 37K and the inner wall seal 322 being increased. In this case, the rotating torque for rotating the shaft 33 to move the moving wall 32 is excessively increased, thereby the first motor M1 (FIG. 7) being required to have a large driving torque. In addition, in the case where the taper angle θ1 is under 0.5 degrees, the amount of compression of the inner wall seal 322 becomes difficult to be increased along the first direction.

Further, in the present embodiment, as described above, the toner replenishment technique of volume replenishment type has been adopted. In other words, in accordance with the quantity of toner in the retaining part 29 (FIG. 5) of the developing apparatus 20, the toner is replenished from the toner container 30 to the developing housing 210 of the developing apparatus 20. Referring to FIG. 15, in the case where the moving wall 32 is located in the initial position 32P1 or the moving position 32P2, a sufficient quantity of toner is stored in the storing space 37S, thereby the space above the toner discharge port 377 being filled with toner with the moving wall 32 being moved. However, when the moving wall 32 is located in the moving position 32P3 or the final position, the quantity of toner that is stored above the toner discharge port 377 is small in comparison to that which is provided when the moving wall 32 is in the initial position.

In this case, the pressing force with which the replenishing toner remaining in the storing space 37S of the toner container 30 presses the toner in the retaining part 29 in the developing housing 210 from upward to downward tends to be weakened. As a result of this, the dropped quantity of replenishing toner is decreased. According to the above configuration, the cross-sectional area of the internal space 37H is set so as to be decreased toward the final position of the moving wall 32. Therefore, the rate of decrease in volume of the storing space 37S is enhanced in the vicinity of the toner discharge port 377, the density of toner in the storing space 37S being increased. In other words, due to the moving wall 32 being moved in the first direction, the toner density in the storing space 37S is maintained substantially constantly. Therefore, even in the case where the moving wall 32 approaches the final position, the pressing force with which the replenishing toner presses downward the toner in the retaining part 29 of the developing housing 210 is kept unchanged, thereby the replenishing toner flowing into the side of the developing housing 210 in a stable manner in accordance with the decrease in the quantity of toner in the retaining part 29. As a result of this, the toner in the toner container 30 is supplied to the developing apparatus 20 in a stable manner to the last.

As described above, when the moving wall 32 is moved from the side of the lid part 31 toward the side of the right wall 375, the inner peripheral part 37K is gradually reduced in diameter from the opening part on the left side of the container main body 37 toward the right wall 375, and on the basis of such reduction, the cross-sectional area of the internal space 37H is set. In the present embodiment, the container main body 37 is formed of a resin material, and is produced by the mold molding technique, thereby the cross-sectional area of the internal space 37H being efficiently set. Specifically, the mold to mold the container main body 37 includes a cylindrical first mold (not shown) that is provided with a recessed part to form the outer peripheral face of the container main body 37, and a columnar second mold (not shown) that is inserted into the recessed part of the first mold in the first direction to form the inner peripheral part 37K of the container main body 37. After a resin material being filled between the first mold and the second mold, and cured, the second mold is drawn out from the recessed part toward a direction opposite to the first direction. The inner peripheral face of the first mold is provided with a draft angle that is known. In drawing out the second mold, a taper along the first direction is formed in the inner peripheral part 37K of the container main body 37, thereby the cross-sectional area of the internal space 37H of the container main body 37 being set so as to be decreased as the final position of the moving wall 32 is approached. Thus, at the time of resin molding of the container main body 37, the change in cross-sectional area of the internal space 37H along the first direction can be set. The inner peripheral face of the first mold may be provided with an inclination angle larger than the draft angle.

Herein above, the printer 100 according to the embodiment of the present disclosure has been explained. According to such a configuration, in the printer 100, it is suppressed that, with the moving wall 32 being moved, the toner is leaked to the moving direction upstream side of the moving wall 32. On the other hand, the present disclosure is not limited to this, and, for example, a modified embodiment as described below can be adopted.

(1) In the above embodiment, the printer 100 has been explained by using a monochrome printer, however, the present disclosure is not limited to this. Particularly, in the case where the printer 100 is a tandem type color printer, after the opening/closing cover 100C (FIG. 2) of the printer 100 having been opened, the respective toner containers 30 corresponding to a plurality of colors of toner may be loaded into the casing 101 from above so as to be adjacent to one another.

Figure 16:
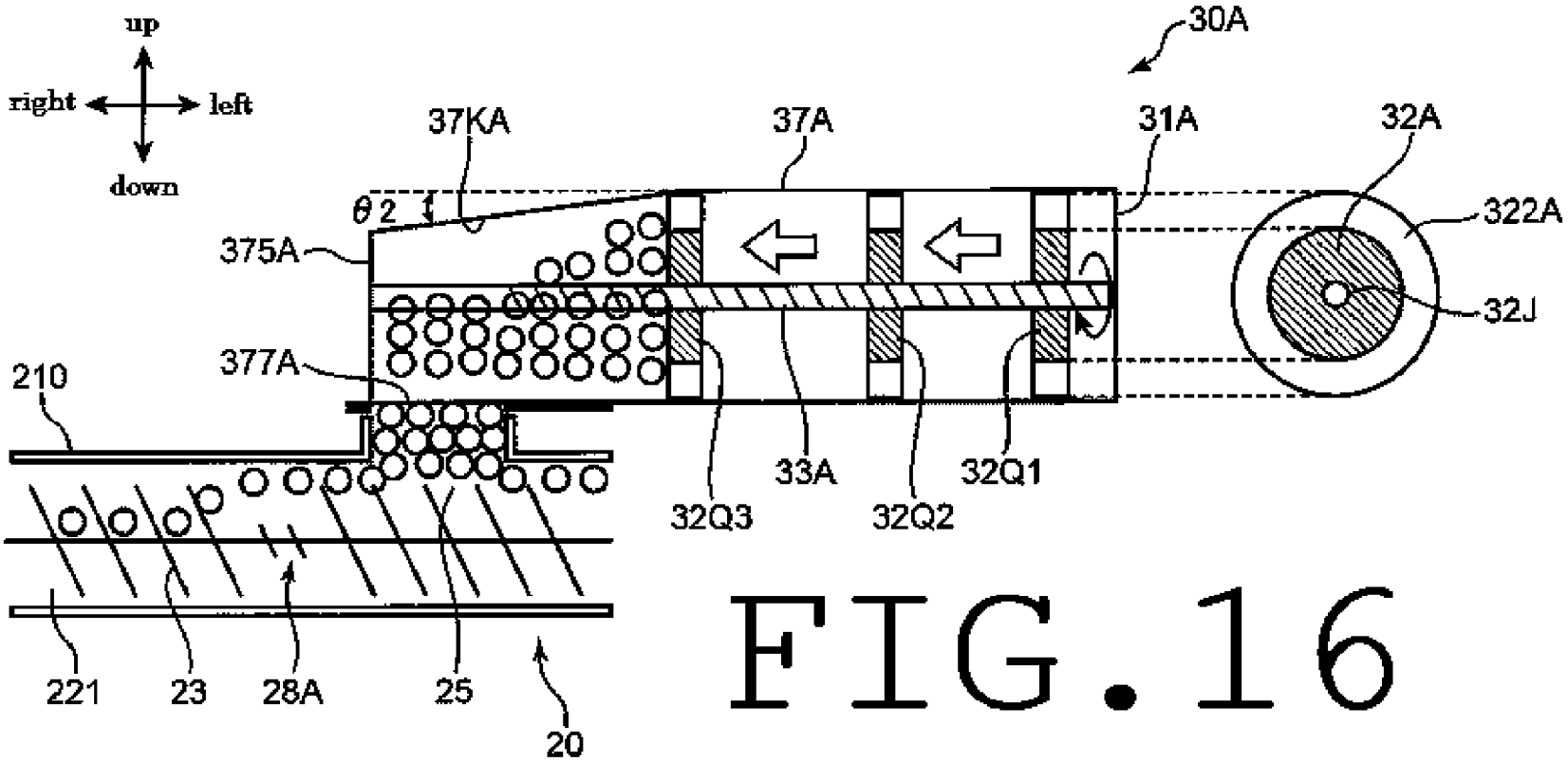
FIG. 16 is a schematic sectional view showing a tapered shape of an inner peripheral part of a container main body of the developer storing container according to one embodiment of the present disclosure.

(2) In addition, in the above embodiment, explanation has been made with an aspect in which the cross-sectional area of the internal space 37H is set so as to be decreased from the initial position of the moving wall 32 to the final position along the first direction, however, the present disclosure is not limited to this. FIG. 16 is a schematic sectional view showing a taper of an inner peripheral part 37KA of a container main body 37A of a toner container 30A according to the modified embodiment of the present disclosure. Also in FIG. 16, for simplifying the explanation, the sectional shapes of the inner peripheral part 37KA and the moving wall 32A are shown as a circular one. Actually, like the embodiment as previously described, the sectional shape of the inner peripheral part 37KA and the moving wall 32A are non-circular.

On the outer peripheral part of the moving wall 32A, an inner wall seal 322A is disposed. Into the bearing part 32J of the moving wall 32A, a shaft 33A is inserted. The moving wall 32A is sequentially moved from an initial position 32Q1 on the side of a lid part 31A to moving positions 32Q2 and 32Q3 in the first direction, reaching a final position on the side of a right wall 375A, where a toner discharge port 377A is opened. In the present modified embodiment, the internal space of the container main body 37A is provided with a first region and a second region. The first region corresponds to a region from the initial position 32Q1 of the moving wall 32A to the moving position 32Q3 in the container main body 37A in FIG. 16. In the first region, the cross-sectional area of the internal space along the first direction is set to be uniform. On the other hand, the second region is a region on the first direction downstream side of the moving position 32Q3 in the container main body 37A in FIG. 16. The second region is provided jointly with the first region on the first direction downstream side thereof, being set such that the cross-sectional area of the internal space is decreased at least to the final position of the moving wall 32A along the first direction. In other words, as shown in FIG. 16, in the second region, the inner peripheral part 37KA is tapered, being provided with a taper angle of θ2.

According to such a configuration, in the first region, the amount of compression of the inner wall seal 322A is set to be substantially constant, and in the second region, the amount of compression of the inner wall seal 322A can be gradually increased. Therefore, at the final stage of movement of the moving wall 32A, the amount of compression of the 322A can be greatly increased. Therefore, to the last, backflow of the toner to the first direction upstream side can be prevented. In addition, the filling rate of the toner in the storing space of the container main body 37A can be enhanced in the vicinity of the toner discharge port 377A, thereby the dropped quantity of toner from the toner discharge port 377A being maintained in a stable manner. Referring to FIG. 16, it is desirable that the taper angle θ2 of the inner peripheral part 37KA be set in the range of 0.5 degrees to 20 degrees, and more desirably, the taper angle θ2 is set in the range of 1 degree to 10 degrees.

(3) In addition, in the above embodiment, explanation has been made with an aspect in which the moving wall 32 is moved from the side of the lid part 31 to the side of the right wall 375, however, the present disclosure is not limited to this. There may be provided an aspect in which the toner discharge port 377 is opened on the side of the lid part 31, and the moving wall 32 is moved from the side of the right wall 375 to the side of the lid part 31. Further, the opening location of the toner discharge port 377 is not limited to the above-mentioned location. The toner discharge port 377 may be opened in the lowest end part of the bottom part 371, or may be opened in still another location.

(4) In addition, in the above embodiment, explanation has been made with the toner replenishing form of volume replenishment type, the present disclosure is not limited to this. In the developing housing 210 of the developing apparatus 20, a toner sensor (not shown) may be provided, and, in accordance with the output of the toner sensor, the moving wall 32 may be moved to replenish the toner from the toner container 30 to the developing apparatus 20. In addition, the developing apparatus 20 is not limited to the one-component development system, and may be that which has adopted the two-component development system.

What is claimed is:

1. A developer storing container, comprising:

a container main body, being provided with an inner peripheral part, cylindrically extending along a first direction, and an internal space, being defined by the inner peripheral part, a developer discharge port, being opened in a bottom face part of the container main body so as to be communicated with the inner peripheral part, and a developer being discharged therefrom, a moving wall, being provided with an outer peripheral part, being disposed in tight contact with the inner peripheral part of the container main body, and a conveying face, defining a storing space together with the inner peripheral part of the container main body, the developer being stored therein; the moving wall being moved from an initial position on the one end side of said first direction to a final position on the other end side thereof in said internal space, while conveying said developer in said storing space toward said developer discharge port, and a sealing member, forming the outer peripheral part of the moving wall, and being compressively deformed between the inner peripheral part of the container main body and the moving wall, a cross-sectional area of the internal space of the container main body in a sectional view intersecting perpendicularly with the first direction being set so as to be decreased as the final position of the moving wall being approached.

2. The developer storing container according to claim 1, wherein the cross-sectional area of the internal space is set so as to be decreased from the initial position of the moving wall to the final position along the first direction.

3. The developer storing container according to claim 1, wherein the internal space of the container main body has a first region where the cross-sectional area is uniform over a prescribed distance along the first direction from the initial position of the moving wall, and a second region that is provided jointly with the first region on the first direction downstream side thereof, the cross-sectional area being decreased along the first direction to the final position of the moving wall.

4. The developer storing container according to claim 1, wherein the container main body is provided with a wall part, defining an end face of the internal space on the other end side of the first direction, further having a lid part, being loaded at an end part of the container main body on the opposite side of the first direction of the wall part, blocking the internal space, the developer discharge port being opened on the side of the wall part in a bottom face part of the container main body, and the moving wall being moved from an initial position on the side of the lid part to a final position on the side of the wall part.

5. The developer storing container according to claim 4, wherein the container main body is produced by resin molding, with a mold for molding, being provided with a first mold, having a cylindrical recessed part to form an outer peripheral face of the container main body, and a second mold, being inserted into the recessed part of the first mold in the first direction to form the inner peripheral part of the container main body; upon the second mold being drawn out from the recessed part, a taper along the first direction being formed in the inner peripheral part of the container main body, thereby the cross-sectional area of the internal space of the container main body being decreased as the final position of the moving wall being approached.

6. An image forming apparatus, comprising:

the developer storing container according to claim 1, an image carrier, an electrostatic latent image being formed on a surface thereof and carrying a developer image thereon, a developing apparatus, the developer being replenished from the developer storing container thereto, and supplying the developer to the image carrier, and a transfer part, transferring the developer image from the image carrier to a sheet.

7. The image forming apparatus according to claim 6, wherein the developing apparatus comprises:

a housing, being provided with a developer carrying passage, conveying the developer in a prescribed conveying direction, a developer replenishing port, being opened in the housing under the developer discharge port, and receiving the developer into the developer carrying passage from the developer storing container, a developer conveying member, being disposed in the developer carrying passage, and conveying the developer in the conveying direction, and a conveying capacity suppressing part, being provided on the downstream side of the developer replenishing port in the conveying direction to partially suppress the capacity of the developer conveying member of conveying the developer toward the conveying direction.

* * * * *